US006834854B2

(12) United States Patent
Inoue et al.

(10) Patent No.: US 6,834,854 B2
(45) Date of Patent: Dec. 28, 2004

(54) SHEET SUPPLY APPARATUS AND IMAGE FORMING APPARATUS

(75) Inventors: Hidemi Inoue, Yamanashi-ken (JP); Satoru Matsuki, Yamanashi-ken (JP); Hidetoshi Kinoshita, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 277 days.

(21) Appl. No.: 10/273,133

(22) Filed: Oct. 18, 2002

(65) Prior Publication Data

US 2003/0085505 A1 May 8, 2003

(30) Foreign Application Priority Data

Oct. 19, 2001 (JP) ..... 2001-322066
Oct. 19, 2001 (JP) ..... 2001-322113
Oct. 19, 2001 (JP) ..... 2001-322182

(51) Int. Cl.[7] ..... B65H 9/04
(52) U.S. Cl. ..... 271/242; 271/236; 271/273
(58) Field of Search ..... 271/242, 245, 271/246, 247, 188, 243, 273, 236

(56) References Cited

U.S. PATENT DOCUMENTS 5,368,285 A 11/1994 Kusumoto
5,494,277 A 2/1996 Flores
5,609,334 A * 3/1997 Silveira et al. ..... 271/188
5,738,349 A * 4/1998 Shirasaki ..... 271/242
5,933,697 A * 8/1999 Onodera et al. ..... 399/406
6,135,446 A * 10/2000 Thiemann et al. ..... 271/228

FOREIGN PATENT DOCUMENTS

JP 11-30884 2/1999
JP 11030884 A * 2/1999 ..... G03G/15/00

* cited by examiner

*Primary Examiner*—Patrick Mackey
(74) *Attorney, Agent, or Firm*—Manabu Kanesaka

(57) ABSTRACT

A sheet supply apparatus includes a sheet storage device for stacking and storing sheets; a sheet pick-up device for drawing the sheets from the sheet storage means; a separating device having supply rollers for supplying the sheets drawn from the sheet pick-up means and separating members pressing the supply rollers; a pair of resister rollers for supplying the sheets to an aligning device after resister correction for aligning a transport direction of the sheets separated and transported by the separating device; and a frame for supporting each of the devices. The sheet supply apparatus is also provided with the first press separating device for the supply rollers and the separating members to be in a sheet nipping state or a sheet released state, and the second press separating device for the pair of the resister rollers to be in a sheet nipping state or a sheet released state.

20 Claims, 21 Drawing Sheets

SHEET SUPPLY APPARATUS AND IMAGE FORMING APPARATUS

BACKGROUND OF THE INVENTION AND RELATED ART STATEMENT

The present invention relates to a sheet supply apparatus mounted to an image forming apparatus (called an image forming apparatus below), such as a copier, printer apparatus or a facsimile machine, and more particularly, it relates to an automatic supply apparatus which is detachably mounted to an image forming apparatus equipped with aligning means that supplies sheets to an image forming means while aligning an edge of supplied sheets to a transport reference member.

Image forming apparatuses are equipped with a supply portion to supply stacked sheets and with image forming means to form images or characters on sheets supplied from the supply portion, and the sheets are transported from the sheet supply portion to the image forming means in a sheet transport path disposed in the image forming apparatus.

In these kinds of image forming apparatus, in order to improve the image forming quality by forming images on predetermined positions on the sheets, an image forming apparatus equipped with aligning means to supply sheets to the image forming means while aligning an edge of the sheets supplied from the sheet supply portion to accurately position the sheets has been provided for practical use. Examples of the image forming apparatuses equipped with such aligning means are disclosed in Japanese Patent Publication No. 08-208078 and U.S. Pat. No. 05,494,277.

The apparatus disclosed is composed of an internal cassette tray for storing sheets inside the image forming apparatus, and the sheets stacked in these cassette trays are supplied to the image forming portion. Normally, the number of sheets stored in these cassette trays is approximately from 250 to 500, so when forming images on a large number of the sheets at a high speed, it is necessary to frequently replenish sheets. For that reason, an automatic sheet supply apparatus that can store a large number of the sheets has been required.

Such a large capacity automatic sheet supply apparatus, as disclosed in Japanese Patent No. 02,625,057 or U.S. Pat. No. 05,368,285, are equipped with an ascending and descending paper deck (support stage) that supports a large number of stacked sheets (generally, approximately from 2,000 to 3,000 sheets) and separation supply means to separate sheets stacked on this paper deck into single sheets and to supply them to a resister roller on the image forming apparatus.

Also, as an apparatus embedded in the image forming apparatus, Japanese Patent Publication (Tokkai) No. 11-30884 disclosed an example of reducing a transport load when transporting on the rollers arranged on the downstream side in the transport path by separating the upstream paired relay rollers after the sheet has reached the downstream side transport rollers. The separation of the paired relay rollers is performed by mounting one roller to a swinging lever and moving this lever using a solenoid.

However, there are several problems associated with mounting the aforementioned aligning means equipped with the conventional large capacity automatic sheet supply apparatus to an image forming apparatus.

Firstly, after the sheets from the automatic sheet supply apparatuses reach the aligning means on the image forming apparatus, they are moved in a direction traversing the sheet transport direction along the transport reference, but when the sheets are nipped in the separation supply means, the sheets are not smoothly moved in the sheet transport reference side. Particularly, increasing the transport force of the alignment means increases the possibility for the sheets to overrun the transport reference, or when using thin sheets, to bent their edges, and with the pressing contact of the separation supply means, alignment is substantially impossible.

Secondly, it is conceivable to arrange the sheet transport reference on the image forming apparatus side or the alignment means on the sheet automatic sheet supply apparatus, but in this case, it would be unavoidable to increase the size of the sheet supply apparatus.

Thirdly, the aforementioned sheet supply apparatus becomes larger to dispose aligning means in the image forming apparatus to perform resister correction for aligning the leading edge of the sheets supplied after separating and supplying the sheets. For that reason, if the resister means is eliminated, only the aligning means corrects the sheets, thereby making it difficult to perform the proper aligning correction when processing sheets with large bends.

OBJECT OF THE INVENTION

The first object of the present invention is to provide a sheet supply apparatus that can use aligning means to securely align a sheet at a reference position even if the sheet supply apparatus is mounted to an image forming apparatus equipped with the aligning means.

The second object of the present invention is to provide an apparatus that can mount a sheet supply apparatus to an image forming apparatus equipped with aligning means, and also to provide a compact apparatus that performs resister correction with the sheet supply apparatus in advance.

The third object of the present invention is to provide an apparatus that can mount a sheet supply apparatus to an image forming apparatus equipped with aligning means, and also to provide a sheet supply apparatus that can separate and supply sheets at a high speed even if the sheets has various thickness.

Furthermore, an object of the present invention is to provide a sheet supply apparatus that can supply sheets efficiently at a high speed through properly supplying or transporting the sheets according to control of a sheet nipping state or a sheet releasing state at a sheet separating means and a resister roller means when the sheets are supplied from the sheet separating means to the resister roller means in the sheet supply apparatus or when the resister roller means performs resister correction and the sheets are supplied downstream.

SUMMARY OF THE INVENTION

In order to attain the aforementioned objectives, the present invention is a sheet supply apparatus that supplies sheets to an image forming apparatus unit having sheet aligning means for aligning the sheets to a predetermined sheet transport reference in a sheet transport direction. The sheet supply apparatus includes sheet storage means for stacking and storing the sheets; sheet pick-up means for feeding the sheets from the aforementioned sheet storage means; separating means having supply rollers for supplying the sheets fed from the aforementioned sheet pick-up means and separating members pressing the aforementioned supply rollers; a pair of resister rollers for feeding the sheets to the aforementioned aligning means after resister correction for aligning a transport direction of the sheets separated and transported in the aforementioned separating means; and a frame for supporting each of the aforementioned means. The sheet supply apparatus is also provided with the first press separating means for the aforementioned supply rollers and the aforementioned separating members to be in a sheet nipping state or a sheet released state, and the second press separating means for the aforementioned pair of the resister rollers to be in a sheet nipping state or a sheet released state.

In the sheet supply apparatus according to the present invention, it is possible for the aligning means to securely align the sheets at a reference position because the sheet nipping state is released after the sheets are fed to the aligning means in the image forming apparatus.

Further, the present invention is an image forming apparatus that comprises the first unit having sheet aligning rollers for aligning sheets at a predetermined sheet transport reference side in the sheet transport direction while transporting the sheets, and the second unit detachably mounted to the aforementioned first unit. The second unit includes sheet storage means for stacking and storing the sheets; sheet pick-up means for feeding the sheets from the aforementioned sheet storage means; separating means having supply rollers for supplying the sheets fed from the aforementioned sheet pick-up means and separating members pressing the aforementioned supply rollers; a pair of resister rollers for feeding the sheets to the aforementioned aligning means after resister correction for aligning a transport direction of the sheets separated and transported in the aforementioned separating means; and a frame for supporting each of the aforementioned means. The image forming apparatus is also equipped with the first press separating means for the aforementioned supply rollers and the aforementioned separating members to be in a sheet nipping state or a sheet released state, and the second press separating means for the aforementioned pair of the resister rollers to be in a sheet nipping state or a sheet released state.

With this configuration, after the sheets are fed to the unit comprising the sheet aligning rollers, the sheet nipping is released, thereby enabling the secure positioning alignment of the sheets using the aligning means.

Still further, the present invention is a sheet supply apparatus equipped with separating means comprising supply rollers and separating members pressing the rollers disposed in a sheet transport path; a pair of relay rollers for transporting sheets separated by the separating means in a transport direction downstream of the sheet supply path; the first drive means for rotating the aforementioned supply rollers in a sheet supply direction with forward rotation, and having the first press separating means for the aforementioned supply rollers and separating members to be in a sheet nipping state or a sheet released state with reverse rotation; the second drive means for rotating the pair of the relay rollers in a sheet supply direction with forward rotation, and having the second press separating means for the pair of the relay rollers to be in a sheet nipping state or a sheet released state with reverse rotation; and a drive control means for the supply rollers and the separating means to be in the sheet released state by switching the aforementioned first drive means from the forward rotation to the reverse rotation after a leading edge of the sheets reaches the pair of the relay rollers, and for the pair of the relay rollers to be in the sheet released state by switching the second drive means from the forward rotation to the reverse rotation after the leading edge of the sheets reaches the predetermined position downstream in the sheet transport direction.

Therefore, according to the present invention, when sequentially feeding the sheets between the rollers, it is possible to drive for feeding the sheets with the rollers and to move the rollers to the sheet nipping released state with one single motor. Thus, it is possible to smoothly feed the sheets to the aligning means for aligning the sheets at the predetermined sheet transport reference in the sheet transport direction from the sheet supply apparatus with a simple mechanism.

In addition, the present invention is a sheet supply apparatus for separating and supplying stacked sheets includes sheet storage means for stacking and storing the sheets; sheet pick-up means for feeding the sheets from the aforementioned sheet storage means; separating means having supply rollers for supplying the sheets fed from the sheet pick-up means and separating members pressing the supply rollers; a pair of resister rollers for aligning a leading edge of the sheets separated by the aforementioned separating means and for feeding the sheets to transport rollers arranged downstream in a sheet supply path; the first press separating means for the aforementioned separating means to be in a sheet nipping state or a sheet released state; the first drive means for driving the aforementioned separating means; the second press separating means for the pair of the resister rollers to be in the sheet nipping state or the sheet released state; and the second drive means for driving the pair of the resister rollers. The first press separating means shifts the aforementioned separating means from the sheet nipping state to the sheet released state after the sheets are fed to the pair of the resister rollers, and shifts the aforementioned separating means to the sheet nipping state after the sheet trailing edge passes the separating means.

With this configuration, it is possible to supply the sheets to the image forming apparatus at a high speed because the sheet pick-up means feeds the next sheet to the sheet separating means while the separating means switches from the sheet released state to the sheet nipping state. Other objectives and features of the present invention will be clearly explained in the following detailed description with reference to the accompanying drawings.

DETAILED DESCRIPTION OF PREFERRED EMBODIMENTS

Below, an example of the preferred embodiments of the image reading apparatus and image reading method according to the present invention will be explained in detail based on the drawings provided.

Figure 1A:
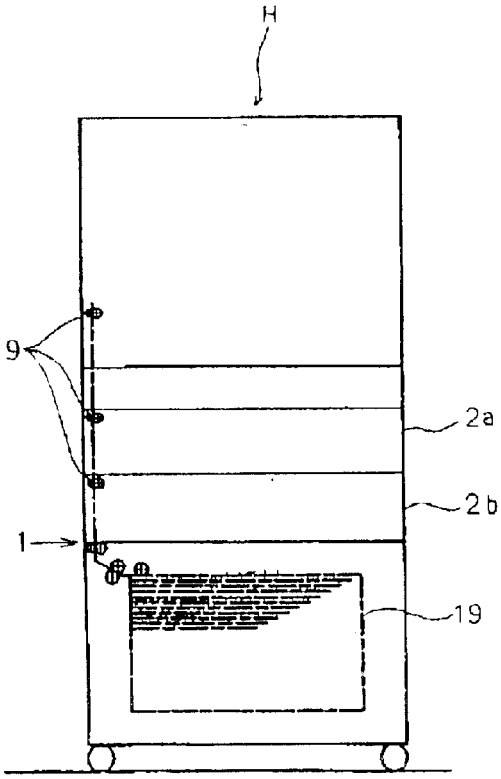
FIG. 1(*a*) and FIG. 1(*b*) show a sheet supply apparatus stored in an image forming apparatus such as a copier in a sheet feeding position.
Figure 1B:
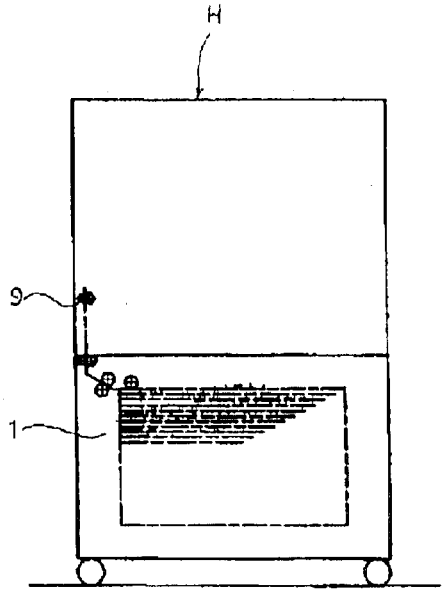
Figure 2:
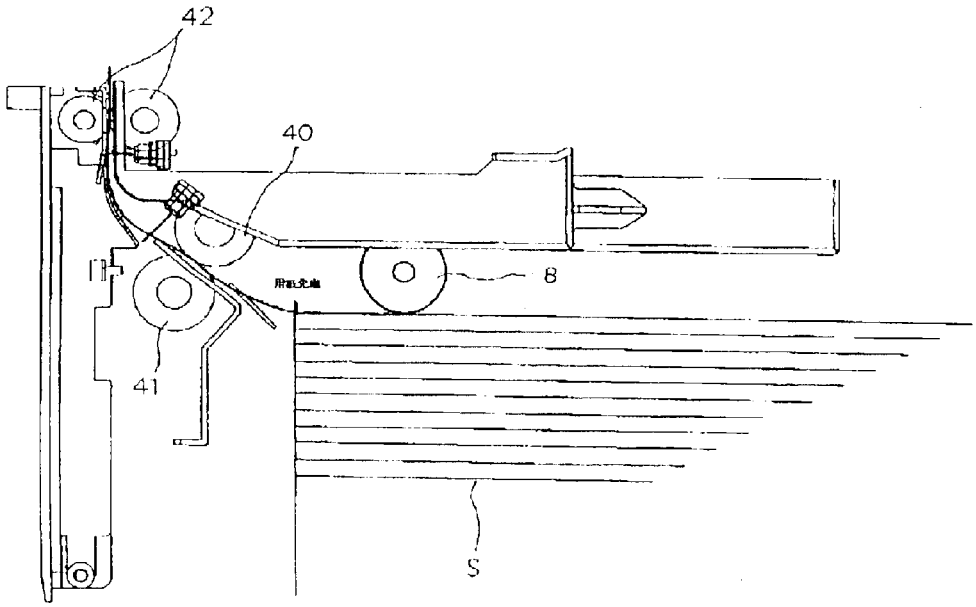
FIG. 2 shows a state that stored sheets are separated into a single sheet and fed by the sheet supply means in the sheet supply apparatus of the present invention.

FIG. 1(*a*) and FIG. 1(*b*) show examples of the sheet feeding apparatus 1(*a*) and (*b*) in the sheet supply position, stored in an image forming apparatus (copy machine) H. FIG. 2 is a drawing showing a sheet stored in the sheet supply apparatus 1 being fed one at a time to a printer by the sheet supply means such as the pick-up rollers 8.

The image forming apparatus H is a printer comprising a laser scanner that scans laser light according to the image information on the upper portion of the apparatus unit H, an image processing unit, transfer rollers, fixer (neither being shown in the drawings) and the transport rollers 9. Also, below the apparatus main unit H is disposed the sheet supply apparatus 1. The sheets S stored in the sheet supply apparatus 1 and 2 are transported by the transport means that includes the pick-up rollers 8 as shown in FIG. 2, to the aforementioned printer under a predetermined timing. The pick-up rollers are supported to freely swing to downstream using the upstream side of the sheet supply direction as the pivot point.

FIG. 1(*a*) shows the configuration with a plurality of sheet supply apparatuses 1, 2*a* and 2*b* disposed on the image forming apparatus H. Each of the sheet supply apparatus 1, 2*a* and 2*b* are configured to function independently. The sheet supply apparatus comprises the sheet size detection means and can stack a variety of sheet sizes. It is possible to allot fixed sizes of sheets to the sheet supply apparatuses 2*a* and 2*b* for use.

Also, FIG. 1(*b*) shows the image forming apparatus H configured with only the sheet supply apparatus that comprises the sheet size detection means and that can stack a variety of sheet sizes. The image forming apparatus H is more compact in comparison to that shown in FIG. 1(*a*) because it supplies sheets only with the sheet supply apparatus 1 that can stack a plurality of sheets sizes. Also, the plurality of sheet supply apparatus 1, 2*a* and 2*b* are detachably mounted to the image forming apparatus H, so it is possible to configure for only the apparatus shown in FIG. 1(*b*) when using a large volume of sheets having the same sizes, or to use the apparatus shown in FIG. 1(*a*) when often using other sizes.

The following shall describe the configuration and operations of the sheet supply apparatus 1 according to the preferred embodiment.

The sheet supply apparatus 1 comprises the sheet storage means (sheet storage cassette) 19, the sheets support stage 7 established in the sheet storage means 19, the support means 30 that movingly supports the sheet storage means 19 in the transport path between the sheet replenishing position and the sheet supply position, the frame 10 on one side of the support means 30 that mounts these, the pick-up rollers 8 that separate sheets into single sheets and feed them one at a time from the sheet storage means 19 at the sheet supply position, and the sheet supply means such as the supply rollers 40, the separation rollers (separating members) 41 and the paired resister rollers 42*a* and 42*b*.

Also, in the sheet storage means 19 are established the sheet regulating means and the trailing edge support guide 5, not shown in the drawings, that regulate the width direction of the sheets.

Also, the sheet supply apparatus 1 is composed of the sheet size detecting means 20 that detects the size of the sheets stored in the sheet storage means 19 in cooperation with the trailing edge support guide 5.

Figure 3:
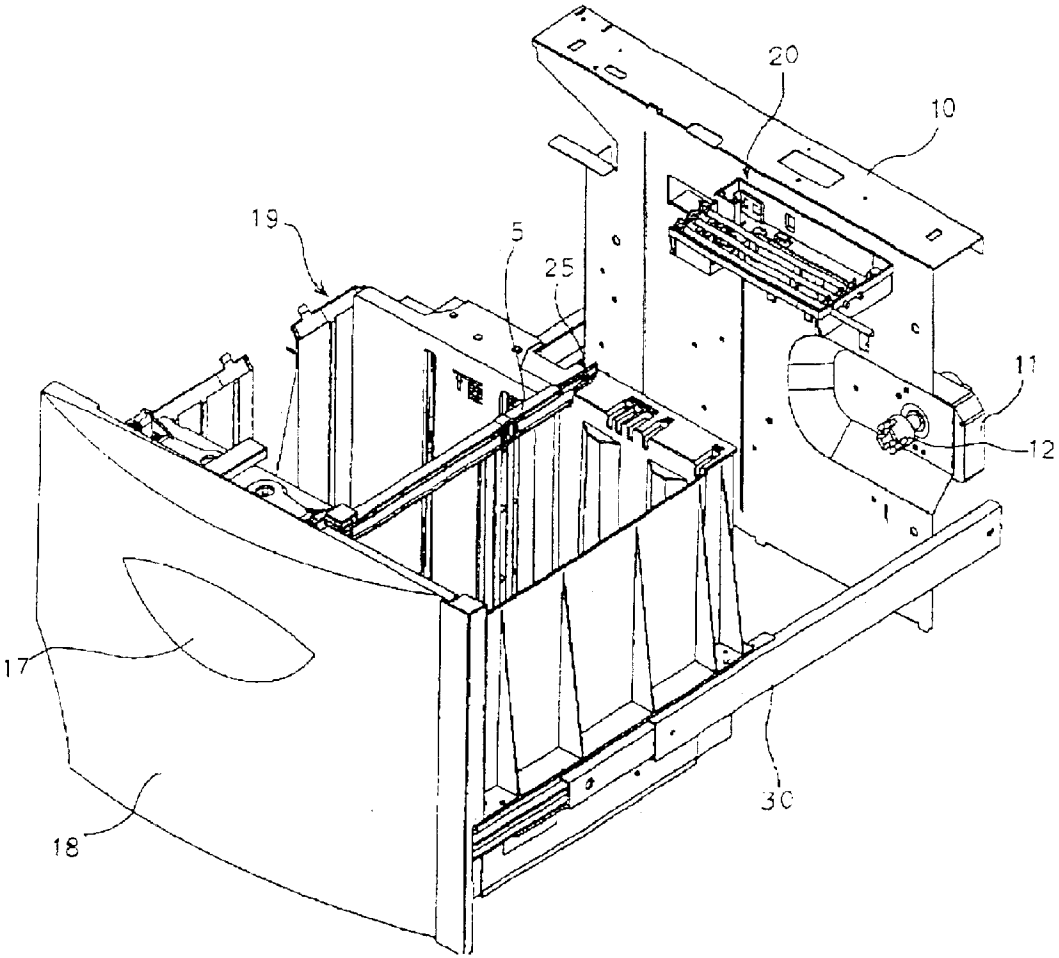
FIG. 3 is a perspective view showing a state that the sheet supply apparatus is pulled out from a frame of the image forming apparatus and is in a sheet replenishment position.

FIG. 3 is a perspective view showing the sheet supply apparatus 1 according to the present invention, the sheet supply apparatus 1 pulled out from the frame 10 in the image forming apparatus H and in the sheet replenishment position.

The sheet storage means 19 (cassette) can be moved to the sheet replenishment position by holding the handle 17 established in the front cover 18 on the sheet storage means 19 stored in the frame 10 and pulling toward yourself. In this movement, the support rail which is the support means 30 that support the sheet storage means 19 is configured to expand and retract. One end of the support means 30 is fastened to the frame.

The sheet storage means 19 is pulled out to the sheet replenishment position guided on the support rails of the support means 30. Sheets can be stored in the sheet storage means 19 when it is pulled out from the frame 10. At this time, the sheet size detecting means 20 and the lift up drive means coupling 12 established on the frame 10 separate from the sheet storage means 19.

The space created between the frame 10 and the sheet storage means 19 when the sheet storage means 19 is pulled out to the sheet replenishment position is the sheet storage means 19 transport path.

Figure 4:
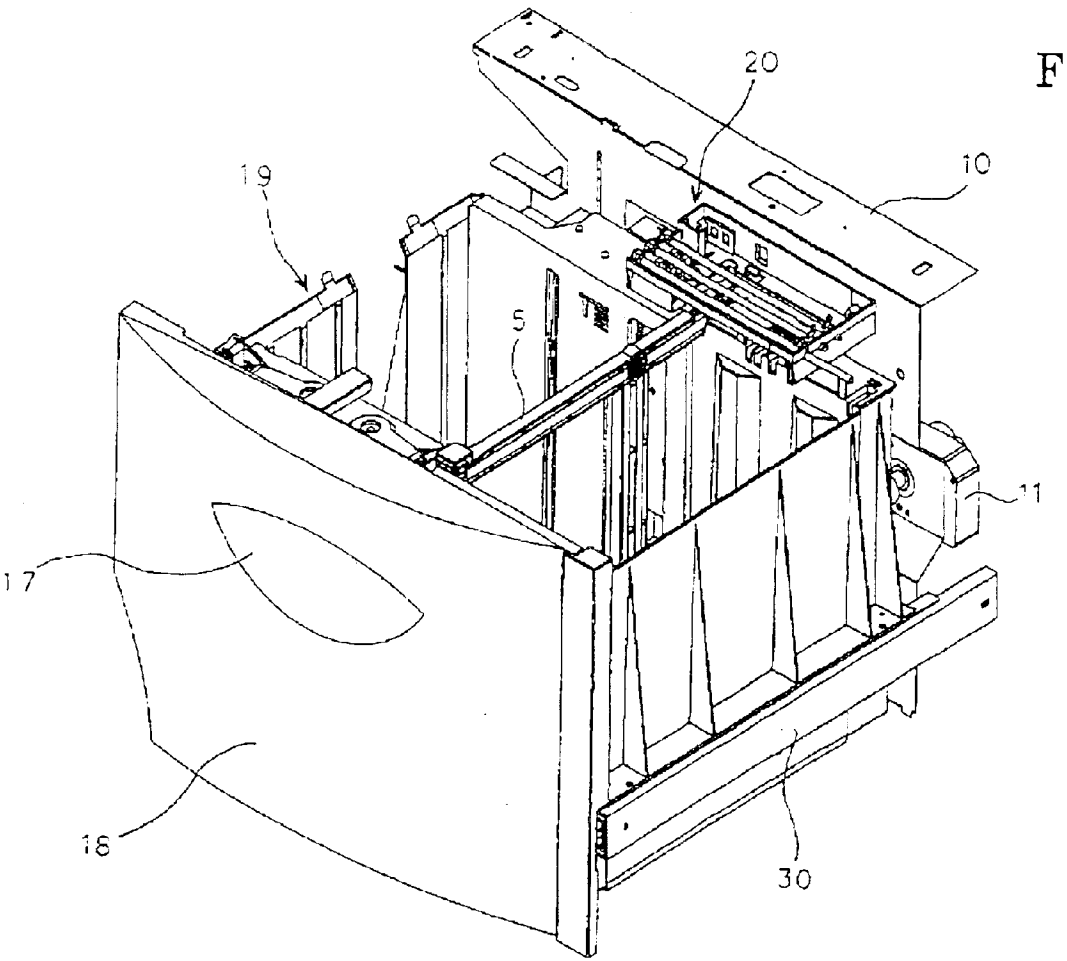
FIG. 4 is a perspective view showing a state that the sheet supply apparatus is located at the sheet supply position in the frame of the image forming apparatus.

FIG. 4 is a perspective view showing the sheet supply apparatus 1 at the sheet supply position in the frame on the image forming apparatus H.

The sheet storage means 19 movement to the sheet supply position is performed by pushing the front cover 18 on the sheet storage means 19 when it is in the sheet replenishment position to push the sheet storage means 19 into the frame on the main unit.

When pushing the front cover on the sheet storage means 19 to push the sheet storage means 19 into the main unit frame, the support rail on the support means 30 that supports the sheet storage means 19 retracts and the sheet storage means 19 moves to the sheet supply position.

The sheet size detecting means 20 is established at the position in the transport path in the frame. For that reason, when the sheet storage means 19 is pushed in and is positioned at the sheet supply position, the sheet size detecting means is arranged in a position overlapping the sheet storage means 19 looking from the sheet stacking direction.

At that time, the lever pressing portion 25 established on one side of the sheet trailing edge support guide 5 is configured to one or a plurality of detection lever contact portions formed on one or a plurality of size detection levers on the sheet size detecting means 20. Also, as a drive transmission means for elevating the sheets support stage 7, the coupling 12 is mated to the pin 14 for the coupling established on the sheet storage means 19.

Here, we shall describe sheet supply in the sheet supply apparatus comprising the sheet aligning means according to the present invention on the main unit image forming apparatus H. Note that in the case of the configuration for the sheet aligning means shown in FIG. 1(*b*), it is perfectly acceptable to have the separate sheet supply apparatus 2*b* unit directly above the sheet supply apparatus 1.

Figure 5A:
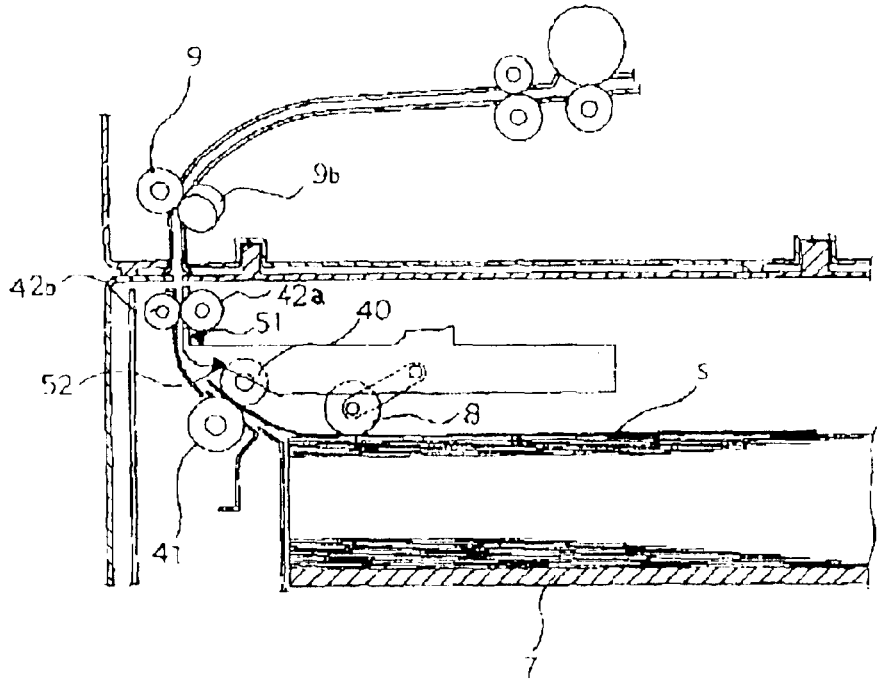
FIG. 5(*a*) and FIG. 5(*b*) are sectional views of the sheet supply apparatus mounted on a lower stage of an image forming apparatus unit, and showing a sheet supply state (No. 1) that a sheet is fed until resister correction of the resister rollers 42.
Figure 5B:
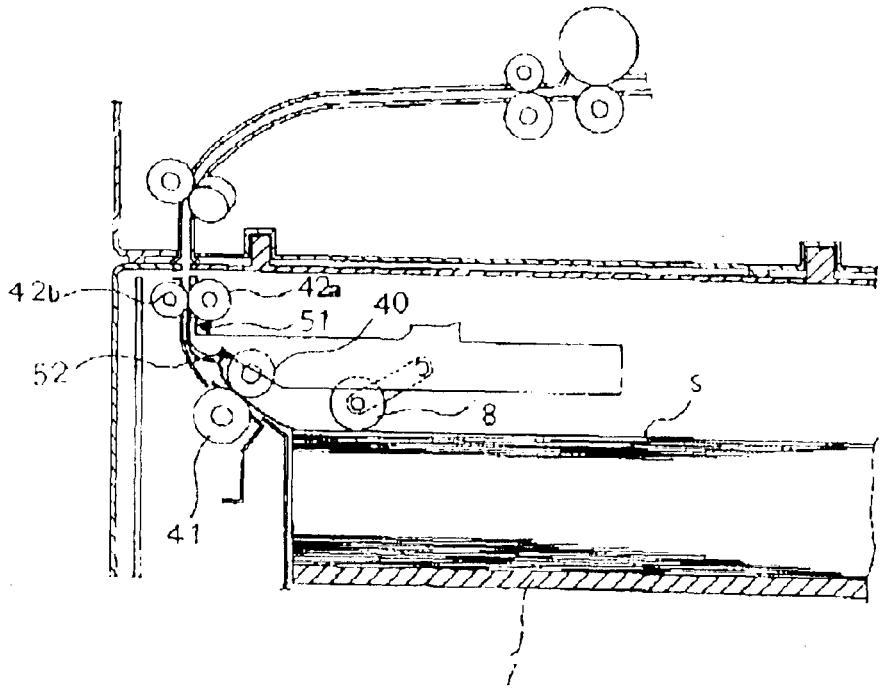

FIG. 5(*a*) and FIG. 5(*b*) are sectional views of the sheet supply apparatus mounted on the lower level of an image forming apparatus unit showing a sheet being fed (No. 1), FIG. 5(*a*) shows the pick-up rollers 8 feeding a sheet stacked in the sheet storage means 19 on the sheet supply apparatus 1 and being fed to the supply rollers 40 and the separation rollers 41. The sheets S stacked in the sheet storage means 19 are lifted up and stopped at the idle position. When the supply signal is received from the main unit, sheet supply is started.

The sheets S stacked in the sheet storage means 19 are raised from the idle position to touch to pick-up rollers 8 which transport the sheets S to the sheet supply roller 40 and paired separation rollers 41.

At this time, the sheet supply roller 40 and the paired separation rollers 41 are able to nip the sheet. The paired separation rollers 41 comprise the function of separating sheets into single sheets.

FIG. 5(*b*) shows sheets supplied by the sheet supply roller 40 and the paired separation rollers 41 to touch the resister rollers 42 and being aligned. The sheet S having been separated into a single sheet passes the resister sensor, and stopped once at the paired resister rollers 42 where it is aligned, then sent to the transport rollers 9 on the image forming apparatus main unit side. At this time, the sheet supply roller 40 and the paired separation rollers 41 nip the sheet.

Figure 6A:
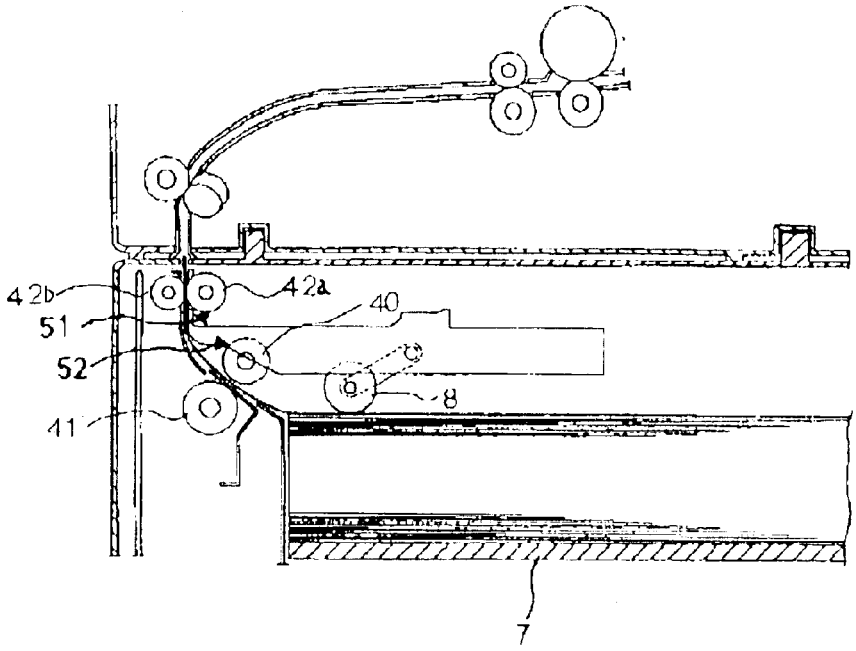
FIG. 6(*a*) and FIG. 6(*b*) are showing a sheet supply state (No. 2) until aligning rollers in a main unit nip the sheet as a continuation of FIGS. 5(*a*) and 5(*b*)
Figure 6B:
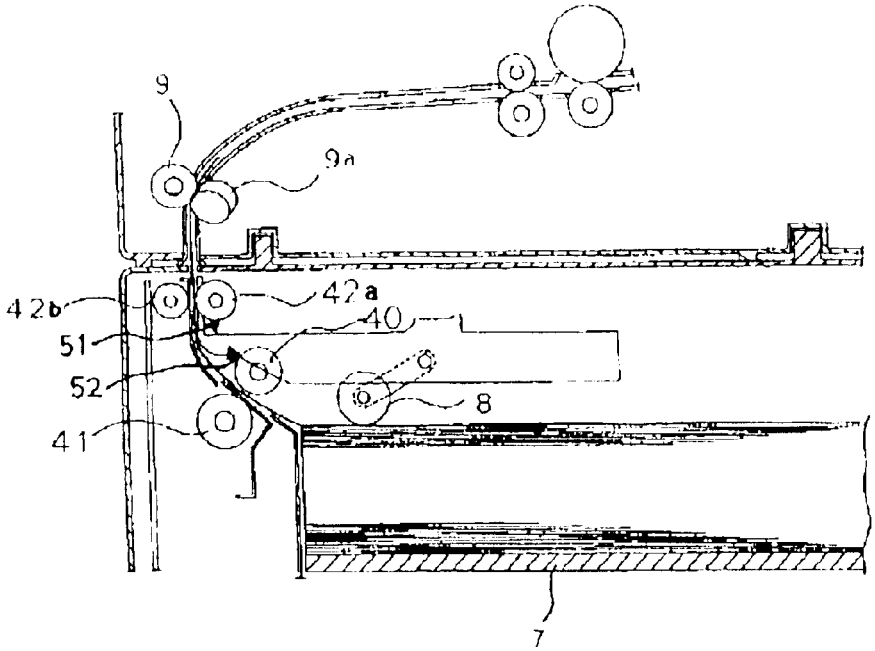

FIG. 6(*a*) and FIG. 6(*b*) show the sheet supply status in continuation from the drawings in FIG. 5(*a*) and FIG. 5(*b*). FIG. 6(*a*) shows the sheet being nipped by the paired resister rollers 42 and being transported to the main unit apparatus. The sheet having been aligned in front of the paired resister rollers 42 is nipped by the paired resister rollers 42 and when it proceeds a predetermined distance, the sheet supply roller 40 and the separation roller 41 separate. The reason for the separation is so that the aligned sheet does not bend. FIG. 6(*b*) shows the sheet transported from the paired resister rollers 42 nipped by the transport rollers 9 on the main unit side and alignment rollers 9*b* and being sent by the alignment rollers 9*b* while one side is against the sheet supply reference. When in this state, the paired resister rollers 42 separate. The sheet supply roller 40 and the paired separation rollers 41 also separate. In this way, the sheet is sent along the sheet supply reference without skewing while being transported against the reference while each of the rollers is separated.

Figure 7A:
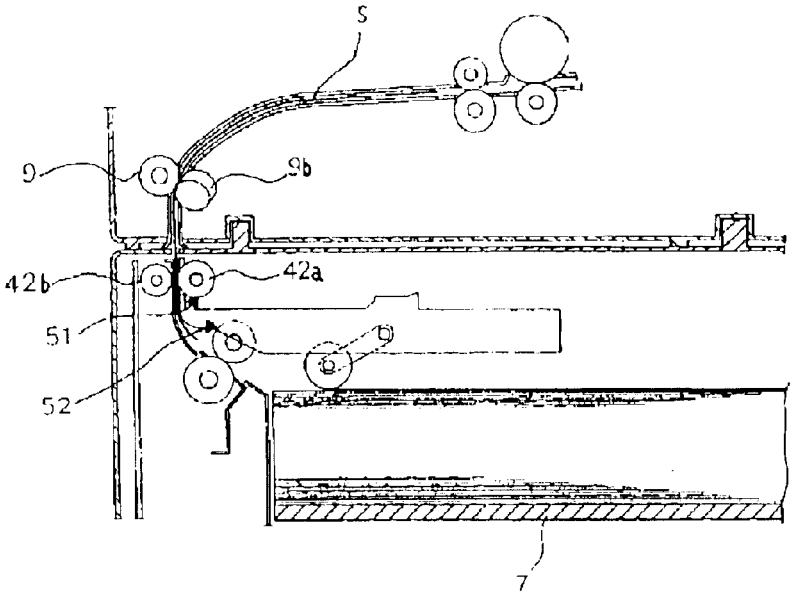
FIG. 7(*a*) and FIG. 7(*b*) are showing a sheet supply state (No. 3) until a trailing edge of the sheet passes the separation rollers 41 and the resister rollers 42 as a continuation of FIG. 6.
Figure 7B:
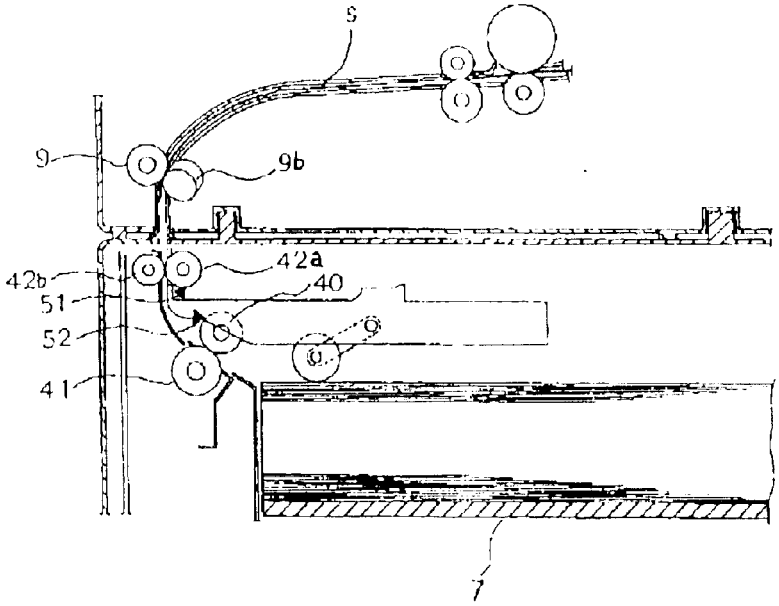

FIG. 7(*a*) and FIG. 7(*b*) show the sheet supply status in continuation from the drawings in FIG. 6(*a*) and FIG. 6(*b*) (No. 3). FIG. 7(*a*) shows the transported sheet trailing edge passing the separation sensor 52. When the trailing edge of the sheet passes the separation sensor 52, the sheet supply roller 40 and the paired separation rollers 41 are pressed together (nip) to prepare for the next sheet to be supplied. As the sheet S that is being transported passes the paired resister rollers 42, the paired resister rollers 42 are in a separated state. FIG. 7(*b*) shows the transported sheet trailing edge passing the resister sensor 51 and being supplied a predetermined distance. The transported sheet trailing edge passes the resister sensor 51, is transported a predetermined distance and when it passes the paired resister rollers 42 the paired resister rollers 42 press together (nip). Here, the sheet supply roller 40, paired separation rollers 41 and the paired resister rollers 42 are ready to accept the next sheet that is sent. Note that it is also acceptable for a configuration where the next sheet is fed when the aforementioned sheet supply roller 40 and paired separation rollers 41 are nipped. In this case, it is possible for even higher speed sheet transport.

The following shall describe the configuration of the separation drive mechanism for the sheet supply roller 40 and the paired separation rollers 41 which are the first press separating means according to embodiment of the present invention.

Figure 8A:
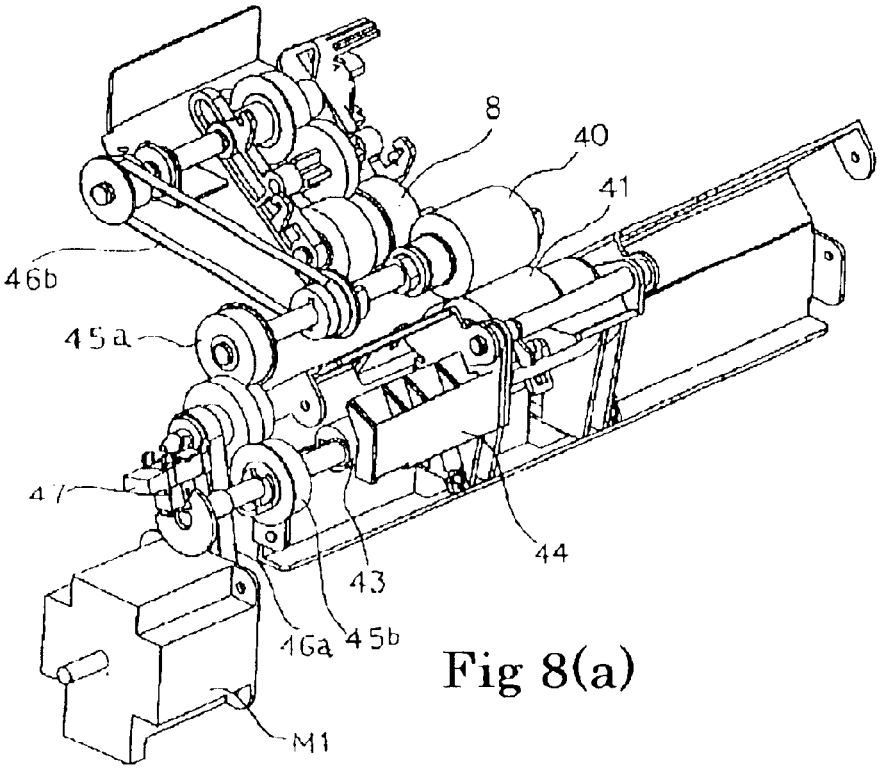
FIG. 8(*a*) and FIG. 8(*b*) are perspective views of the sheet separating drive mechanism in the sheet supply apparatus according to the present invention.
Figure 8B:
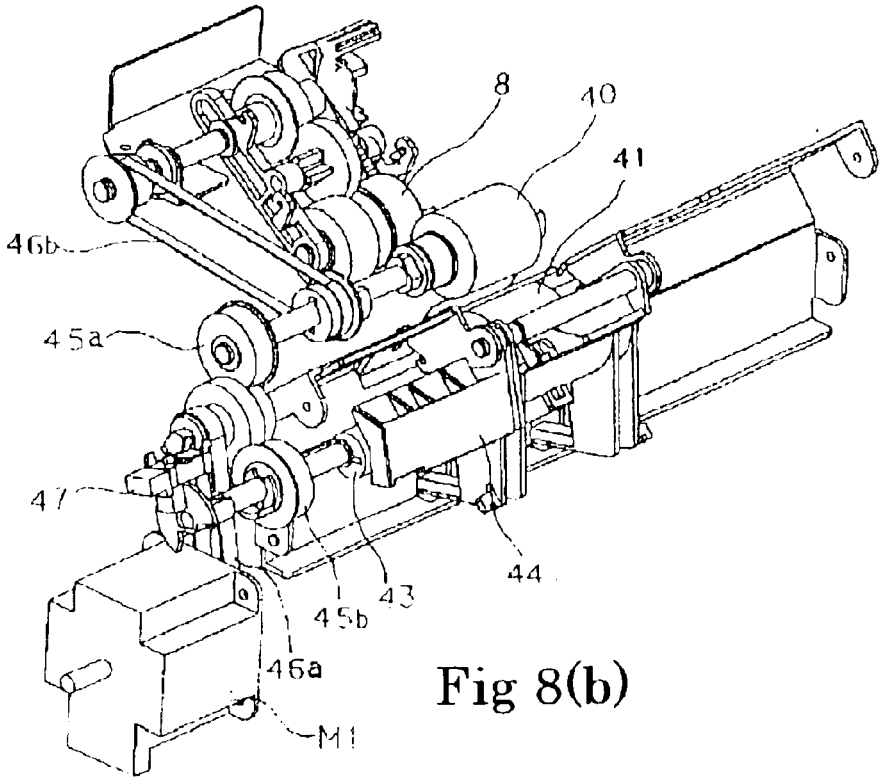

FIG. 8(*a*) and FIG. 8(*b*) are perspective views of the separating drive mechanism for the sheet supply means in the sheet supply apparatus 1. The sheet supply means comprises the pick-up rollers 8 that transport the uppermost sheet S of the sheets stacked in the sheet storage means 19, the sheet supply roller 40 that transport the sheets S supplied from the pick-up rollers 8 to the paired resister rollers 42, the separation rollers 41 opposed to the sheet supply roller 40, that separate sheets into single sheets, the separation roller support member 44, the eccentric cam 43 for separating the separation rollers 41 from the supply roller 40, the one-way clutches 45*a* and 45*b* that transmit rotational drive force to the pick-up rollers 8, sheet supply roller 40, and the separation roller 41, and the belts 46*a* and 46*b* that transmit the drive force of the motor M1.

FIG. 8(*a*) shows the sheets S stacked in the sheet storage means 19 being sent to the supply roller 40 by the pick-up rollers 8, the sheet supply roller 40 and the separation roller 41 in pressing contact to separate the sheets into single sheets for transport. At this time, the eccentric cam 43 separates from the separation roller support member 44 to turn the sensor 47 on.

FIG. 8(*b*) shows the sheet S transported a predetermined distance from the supply roller 40 to the resister rollers 42, the reverse rotational of the separation motor M1 transmitted to rotate the drive eccentric cam 43 to pressingly move the separation roller support member 44 thereby separating supply roller 40 and separation roller 41. By separating the supply roller 40 and the separation roller 41 a second sheet is not supplied until the first sheet has been completely transported and separated from the roller 40. Furthermore, this frees large sized sheets from the nip of the supply roller 40 and the separation roller 41. At this point, the sensor 47 turns off.

Figure 9:
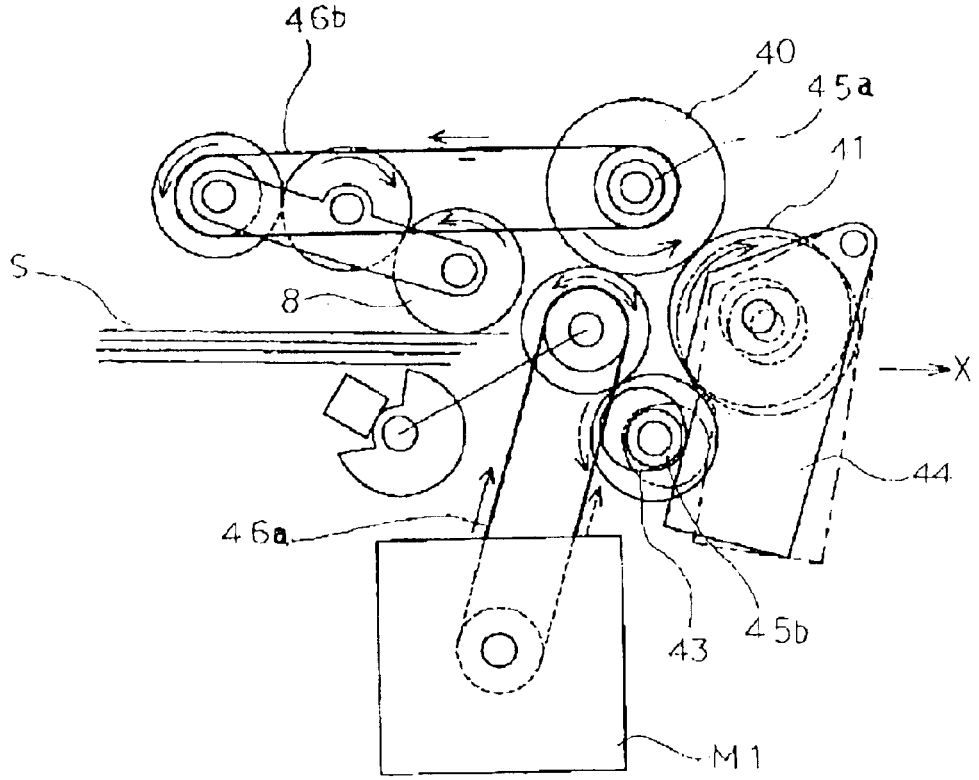
FIG. 9 shows a configuration of the supply rollers and separation rollers separating mechanism of the sheet supply apparatus according to the present invention.

FIG. 9 shows the configuration of the supply roller 40 and separation roller 41 separating mechanism. The sheet S having been aligned in front of the paired resister rollers 42 is nipped by the paired resister rollers 42 and when it proceeds a predetermined distance, the supply roller 40 and the separation roller 41 are separated. The separation operation is described below. The leading edge of the sheet S passes the resister sensor 51 and touches the resister rollers 42 to be aligned. There, the sheet stops once. At this point, the motor M1 stops to stop the separation roller 41. Next, the resister motor M2 rotates, the sheet is nipped by the resister rollers 42 and transported. When the leading edge of the sheet passes a predetermined length (for example 10 mm), the motor M1 starts to rotate in reverse to drive the separation roller 41. The reverse drive rotation is not transmitted to the supply roller 40 because the supply roller 40 is connected to the one-way clutch 45*a*. The reverse rotational drive of the motor M1 is transmitted to the eccentric cam 43 via the belt 46*a* and the one-way clutch 45*b*. The eccentric cam 43 rotates to pressingly move the separation roller support member 44 in the direction of the arrow X. Doing this separates the separation roller 41 from the supply roller 40.

Figure 10A:
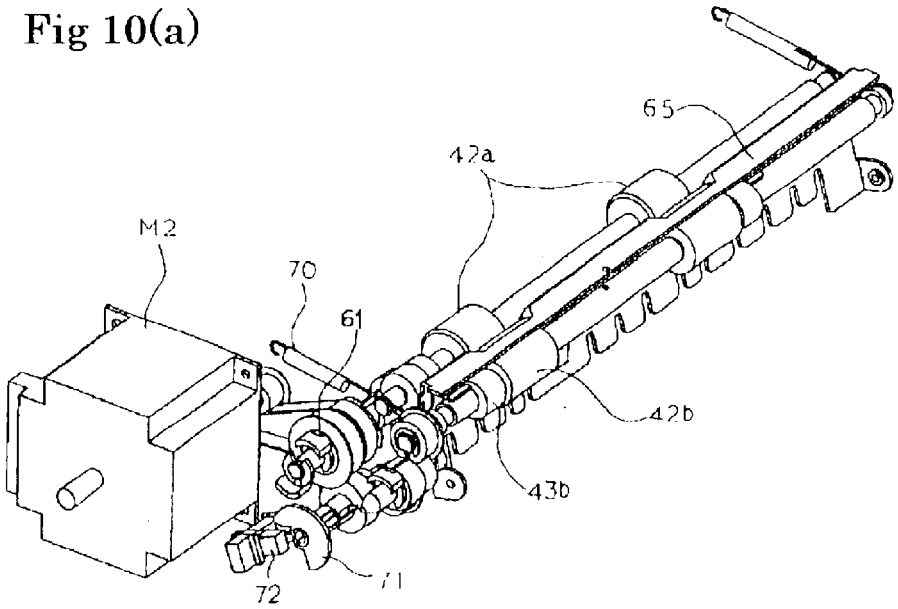
FIG. 10(*a*) and FIG. 10(*b*) are perspective views of the resister roller drive mechanism, wherein FIG. 10(*a*) shows the pair of the resister rollers 42 in a nipped state (in pressing contact), and FIG. 10(*b*) shows the pair of the resister rollers 42 in a released state (separated state)
Figure 10B:
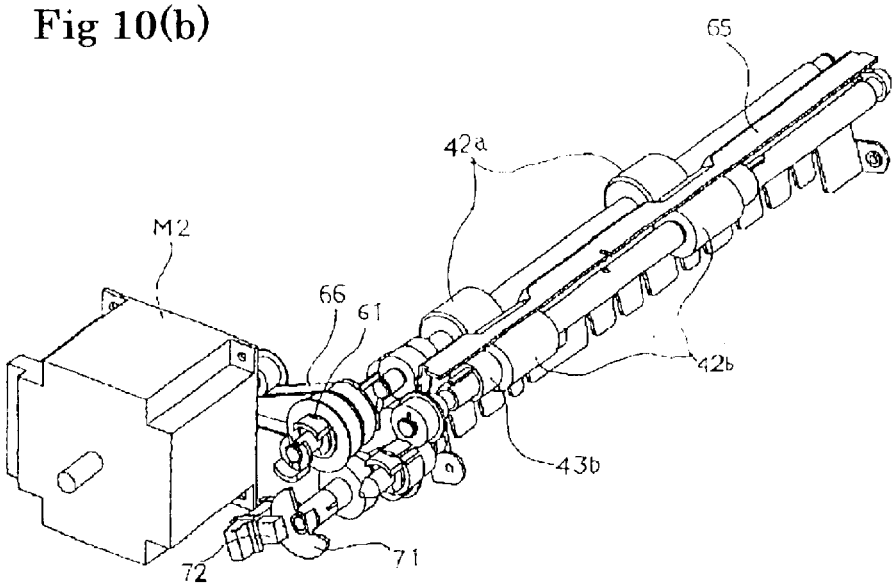

FIG. 10(*a*) and FIG. 10(*b*) are perspective views of the resister roller drive mechanism; FIG. 10(*a*) shows the resister rollers nipped and FIG. 10(*b*) shows the paired resister rollers 42 released. The second drive means comprises the resister motor M2 that forwardly and rotates in reverse to drive the resister rollers 42 and the separating means, the belt 66 that transmits the drive of the resister motor M2 to the resister rollers 42, the paired resister rollers 42*a* and 42*b* that align and transport the sheets to the main unit, the eccentric cam 43*b* for pressing and separating of the resister rollers 42, the guide plate 65 that guides the sheets and supports the eccentric cam, the spring 70 that urges the resister roller 42*b* to the pressing contact direction, and the sensor 72 and cam lug 71 that detect the release of the pressing of the resister rollers.

Figure 11A:
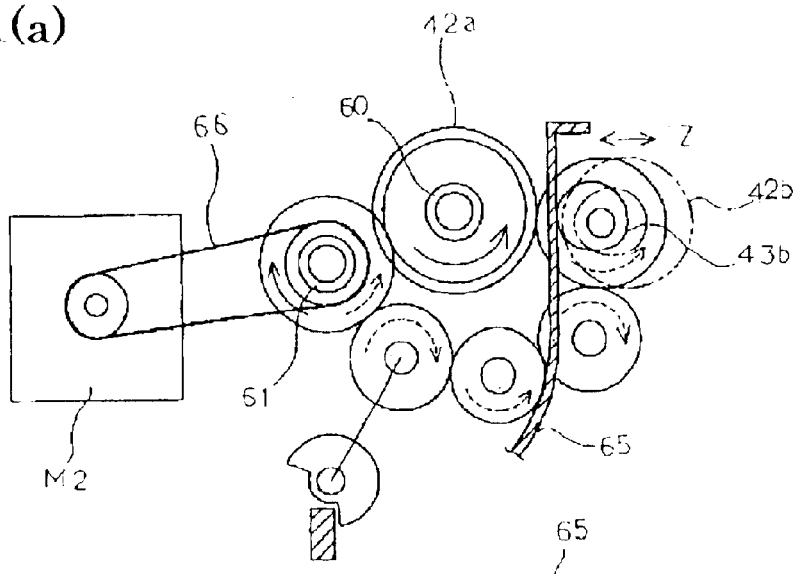
FIG. 11(*a*) and FIG. 11(*b*) show a separating drive mechanism of the resister rollers, wherein FIG. 11(*a*) is a side view of the separating drive mechanism of the resister rollers, and FIG. 11(*b*) is a plan view of FIG. 11(*a*)
Figure 11B:
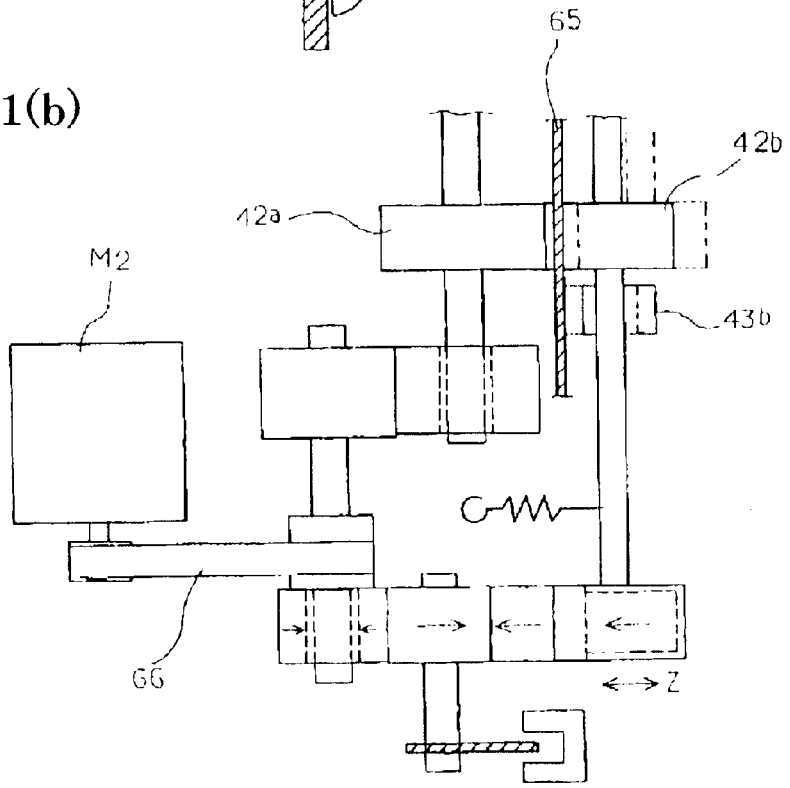

FIG. 11(*a*) and FIG. 11(*b*) show the resister rollers 42 separating means drive mechanism. FIG. 11(*a*) is a side view of the resister rollers 42 separating means drive mechanism. FIG. 11(*b*) is a plan view of FIG. 11(*a*). The sheet transported from the paired resister rollers 42 nipped by the transport rollers 9 on the main unit side and alignment rollers 9*b* are sent by the alignment rollers 9*b* while one side is against the sheet supply reference. In this state, the distance data previously received from the main unit and the transport distance are compared. When it has predetermined that it has supplied the sheet the distance of the distance data, the resister motor M2 starts rotating in reverse. The resister rollers 42*a* is connected to the one-way clutch 60 so it rotates in reverse. The reverse rotational drive of the motor M2 is transmitted to the eccentric cam 43*b* via the belt 66 and the one-way clutch 61. The eccentric cam 43*b* rotates to pressingly move the guide plate 65 in the direction of the arrow Z. Doing this separates the resister roller 42*b* from the resister rollers 42*a*. When the resister rollers 42*b* separation is completed, the sensor 72 turns off, and the resister motor M2 stops.

Next, the trailing edge of the sheet passes the resister sensor 51 and is then sent a predetermined distance. When the trailing edge of the sheet passes the resister rollers 42, a preset timer starts operating and after a predetermined time has passed, the resister motor M2 starts rotating in reverse. The drive of the resister motor M2 is transmitted to the eccentric cam 43*b* via the belt 66. The eccentric cam 43*b* rotates to start the pressing force to pressing the guide plate 65. The resister rollers 42*b* are pressed to the resister rollers 42*a* by urging force of the spring 70. The resister motor M2 stops. At this point, the sensor 72 is turned on and sends the signal for the resister rollers 42 pressing contact to the control device on the main unit.

Here, the sheet supply rollers 40, paired separation rollers 41 and the paired resister rollers 42 are ready to accept the next sheet that is sent.

Incidentally, means are equipped for moving and aligning the edge of sheets supplied from the resister rollers 42 on the sheet supply apparatus according to the present invention on a transport reference 68 by the aligning rollers 9*b*.

Figure 12:
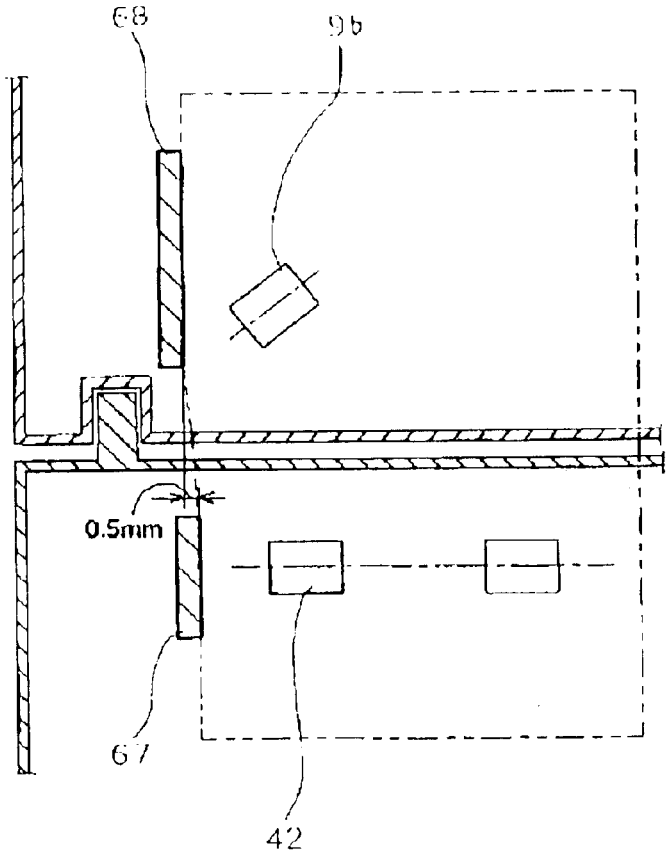
FIG. 12 is a plan view for explaining a transport reference for the resister rollers and aligning rollers on the sheet supply apparatus side to transport the sheets.

FIG. 12 shows the transport references 67 and 68 that the resister rollers 42 on the sheet supply apparatus side and the aligning roller 9*b* on the main unit side use to align the sheets. The sheet supplied from the separation rollers is nipped by the resister rollers 42 and supplied to the transport rollers 9 and aligning rollers 9*b* established on the main unit side. The aligning roller 9*b* is mounted at an angle to the transport reference 68 to align the sheets being supplied. Also, the transport reference 68 on the main unit side is formed further to the outer side than the transport reference 67 on the sheet supply apparatus only a predetermined distance (example 0.5 mm). A side of the sheet supplied by the aligning roller 9*b* is pushed against the transport reference 68 to be aligned. At this time, the paired resister rollers 42 separate to set the sheet to pass the resister rollers to a free state. Through this structure, the sheet S with a different thickness does not bend or distort when striking the transport reference.

Further in this invention, the start of the drive of the first drive means and second drive means are controlled so that their timings do not overlap. The drives of the first drive means and the second drive means are performed for each by the separation motor M1 and the resister motor M2. The CPU 100 controls the starting and stopping of the motor drive by a sensor that detects the position of the rapidly moving sheet and sending that signal to the CPU 100 (control device) which is described below.

Figure 13:
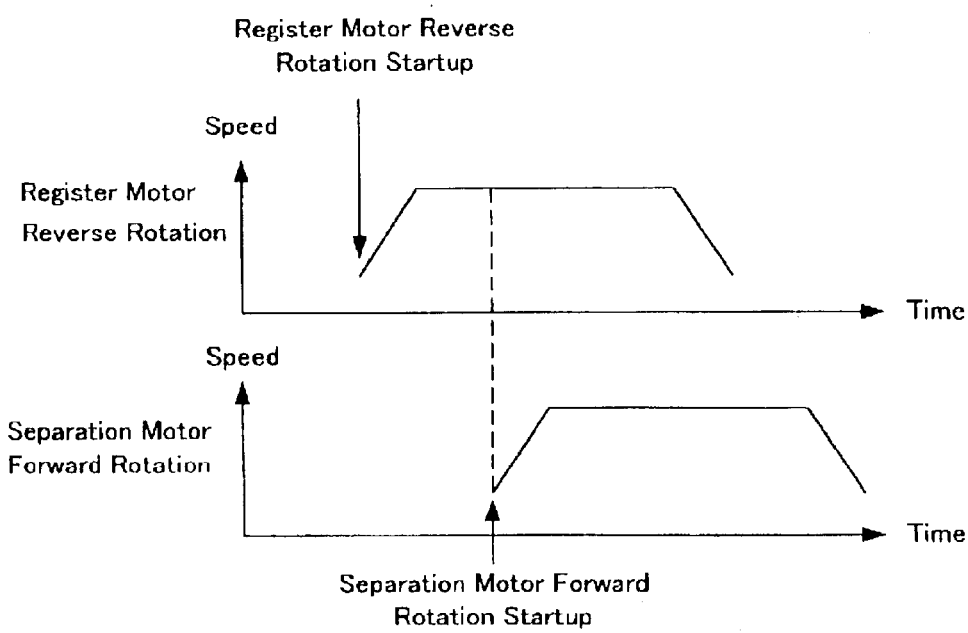
FIG. 13 shows a relationship of the drive speed and starting and stopping of the resister motor M2 and the separation motor M1.
Figure 14:
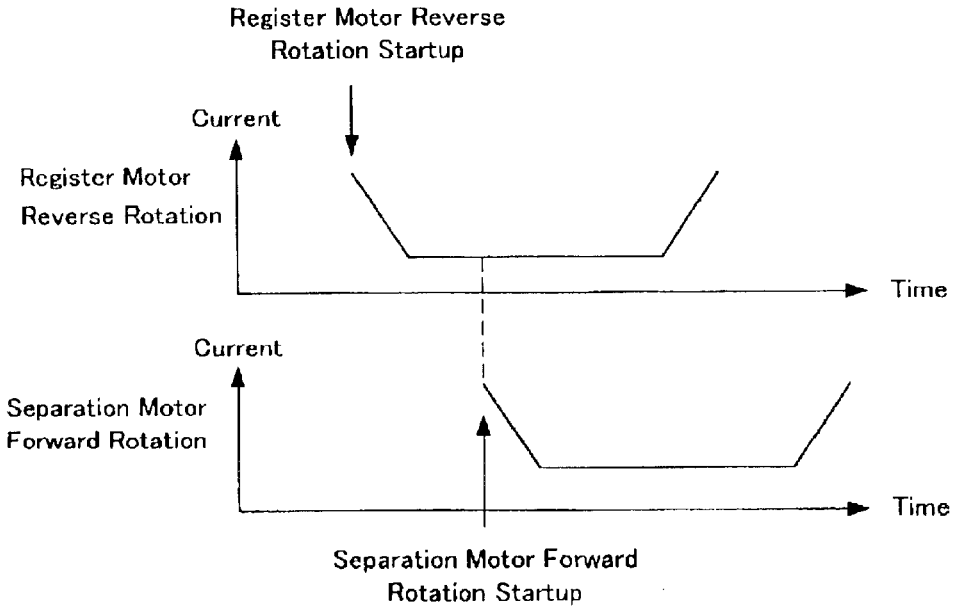
FIG. 14 shows a relationship of current consumption and starting and stopping of the resister motor M2 and the separation motor M1.

FIG. 13 shows the relationship of the drive speed and starting and stopping of the resister motor and the separation motor. FIG. 14 shows the relationship of the current consumption and starting and stopping of the resister motor and the separation motor. When starting and stopping the motor, the current consumption rises. When the rotations reach a predetermined stable rotation count, the power consumption also stabilizes. Current consumption rises also when the motor is stopped.

After the sheet passes the resister rollers 42, the resister motor M2 starts reverse rotation to press the resister rollers together. The separation motor M1 starts forward rotation to start driving the separation rollers to supply the next sheet. At this time, when both the resister motor M2 and the separation motor M1 are started simultaneously, the power consumption rises dramatically and can mal-effect the other parts.

According to this invention, the startup times are offset so that the resister motor M2 and the separation motor M1 do not overlap when starting up.

Figure 15:
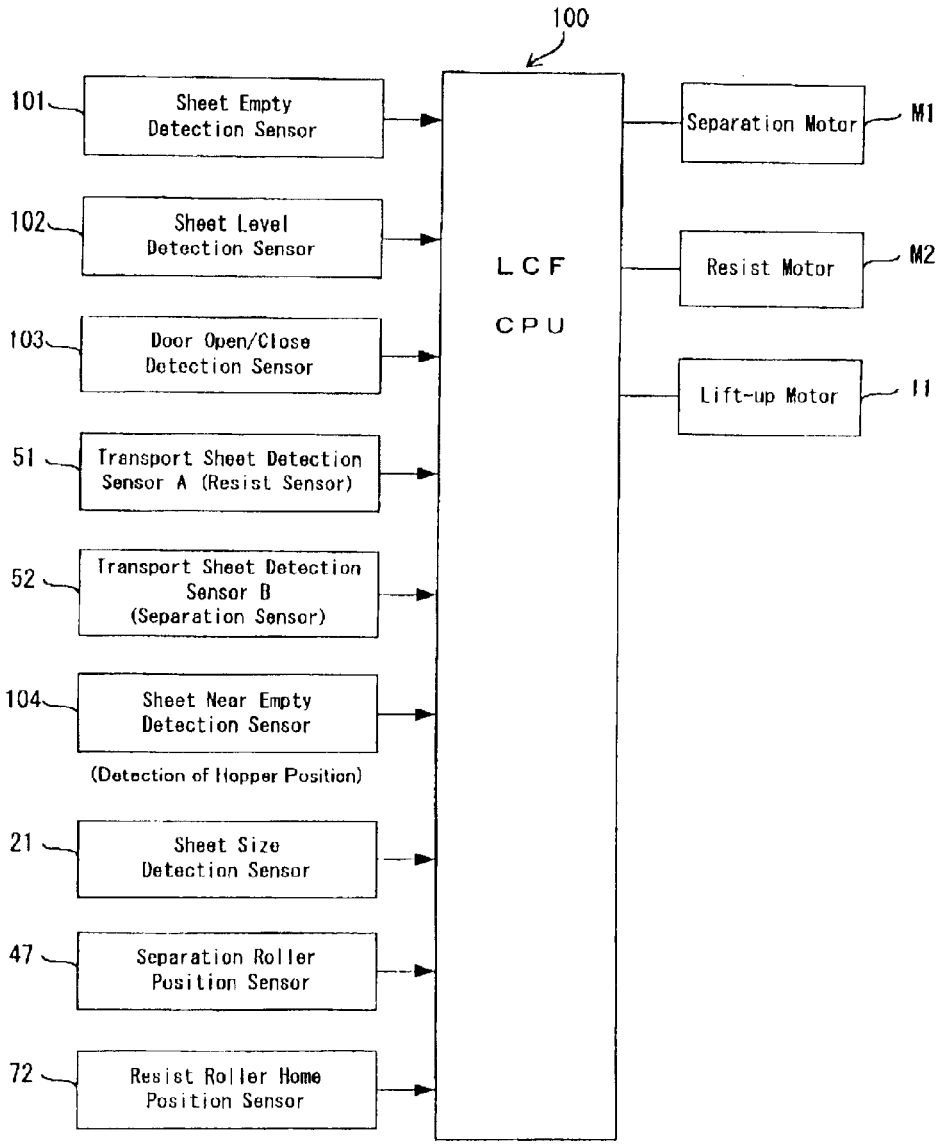
FIG. 15 is a block diagram showing a configuration of a control mechanism in the image forming apparatus and sheet supply apparatus.

FIG. 15 is a block drawing showing the configuration of the control mechanism for the image forming apparatus and sheet supply apparatus according to the present invention. The control of the sheet supply is composed of the CPU 100 to store the programs and data and to control each apparatus, and each of the sensors of the sheet empty detection sensor 101 connected to the CPU 100 that detects sheet transport data and sends that detected data to the CPU, the sheet level detection sensor 102, the door open/closed detection sensor 103, the transport sheet detection sensor A (resister sensor 51), the transport sheet detection sensor B (separation sensor 51), the sheet near empty detection sensor 104, the sheet size detection sensor 21, the separation roller home position sensor 47 and the resister roller home position sensor 72.

Furthermore, connected to the CPU 100 are the separation motor M1 that applies the drive for the separation rollers to separate and the press together and the drive to transport sheets using the separation rollers, the resister motor M2 that applies the drive for the resister rollers to separate and the press together and the drive to transport sheets using the resister rollers, and the lift-up motor M11 for ascending and descending the hopper that stacks sheets.

The following shall describe the sheet supply operations of the image forming apparatus H and the sheet supply apparatus 1.

Figure 16:
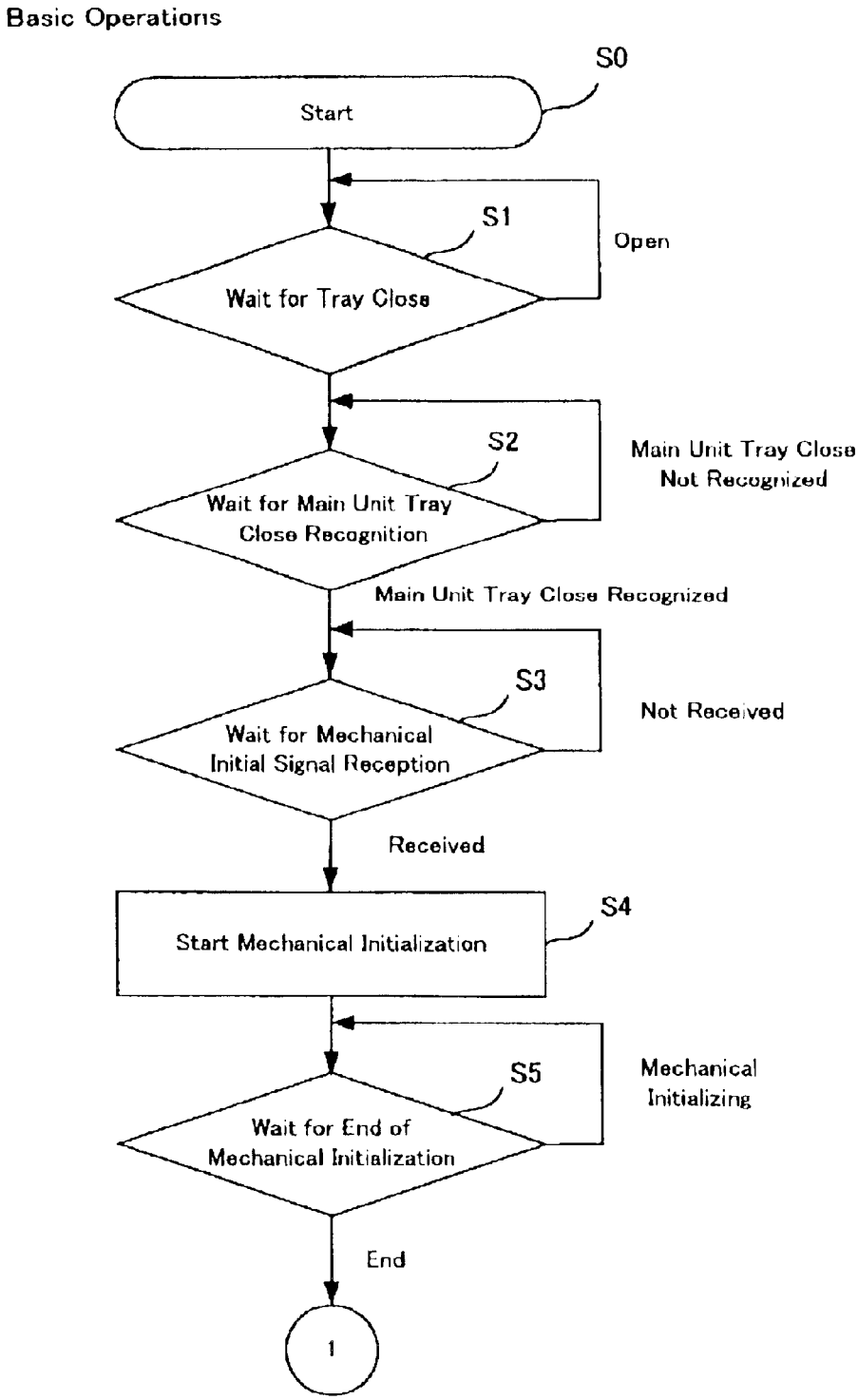
FIG. 16 is a flow chart (No. 1) showing a basic operation of starting sheet supply in the image forming apparatus and sheet supply apparatus.

FIG. 16 is a flow chart showing the basic operation to start sheet supply on the image forming apparatus H and the sheet supply apparatus 1.

The sheet supply apparatus 1 starts when the power is turned on to the main unit H (S0). It checks if the tray is closed (S1, S2), and if it is closed, it waits for the mechanical initializing signal (S3). When the mechanical initialize signal is received, the initialization process is started (S4). In this initialization process, the sheets are lifted to the idle position and the resister rollers 42 and separation roller 41 are returned to their home positions. In the operations to return them to their home positions, the rollers are rotated in the directions to press together and then to separate (reverse rotations to that of transport) and when the home position is detected by the encoder sensor, the operation stops the motor (S5).

Figure 17:
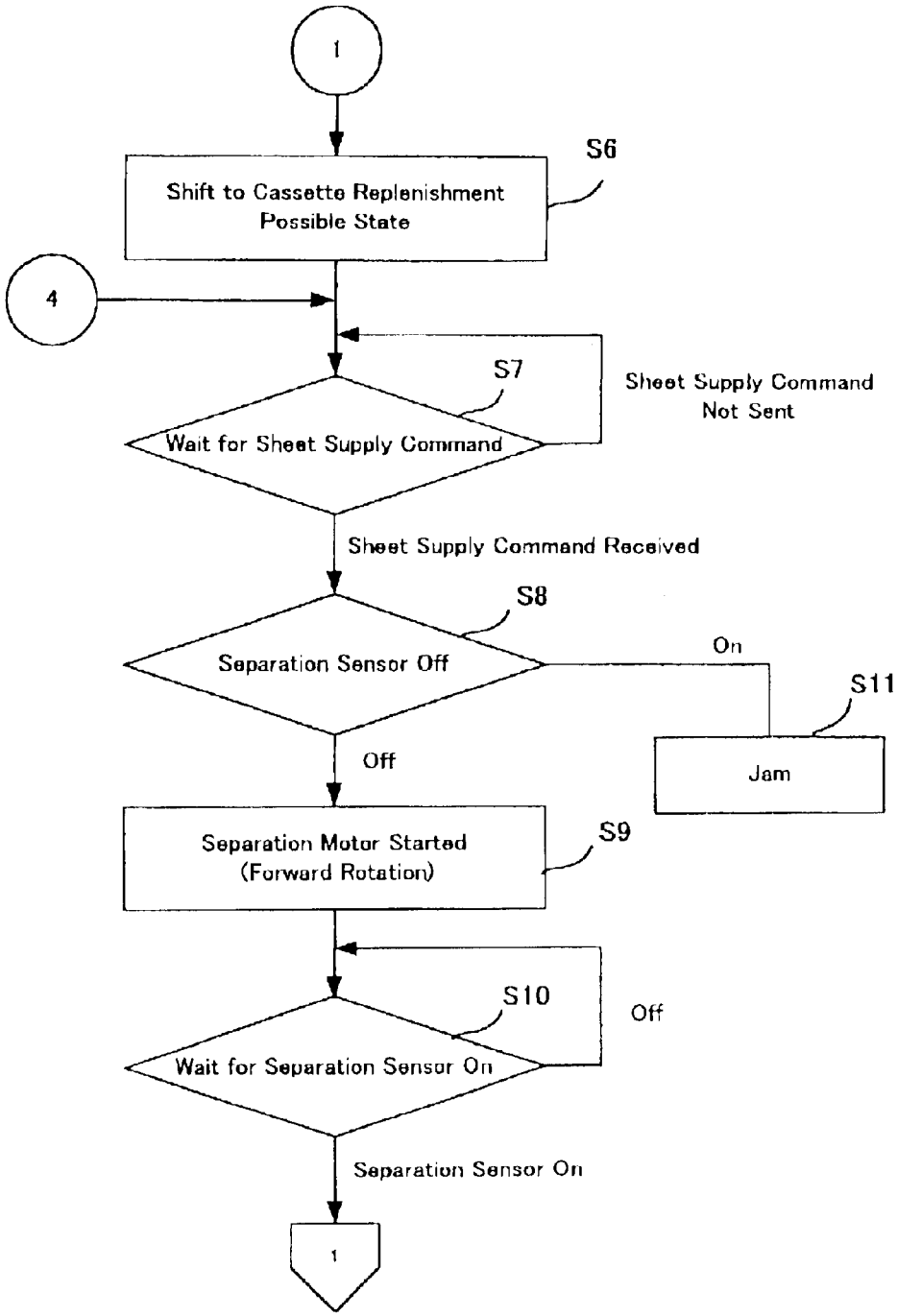
FIG. 17 is a flow chart (No. 2) continued from FIG. 16 to explain the flow of the sheet supply operation.

FIG. 17 is a flow chart continued from FIG. 16 to explain the flow of the sheet being transported to the separation rollers. When the initialization process is completed, the cassette enters a transport ready state and waits for the transport command from the main unit (S6, S7).

When the transport command from the main unit is sent, the resister sensor 51 and separation sensor 52 check whether sheets have been detected (S8). If sheets are not detected by the sensor, it starts the separation motor M1 (forward rotation) because there are no sheets in the transport path (S9). It continues to drive the separation motor M1 to feed the sheets until the leading edge of the sheet is detected by the separation sensor 52 (S10).

Figure 18:
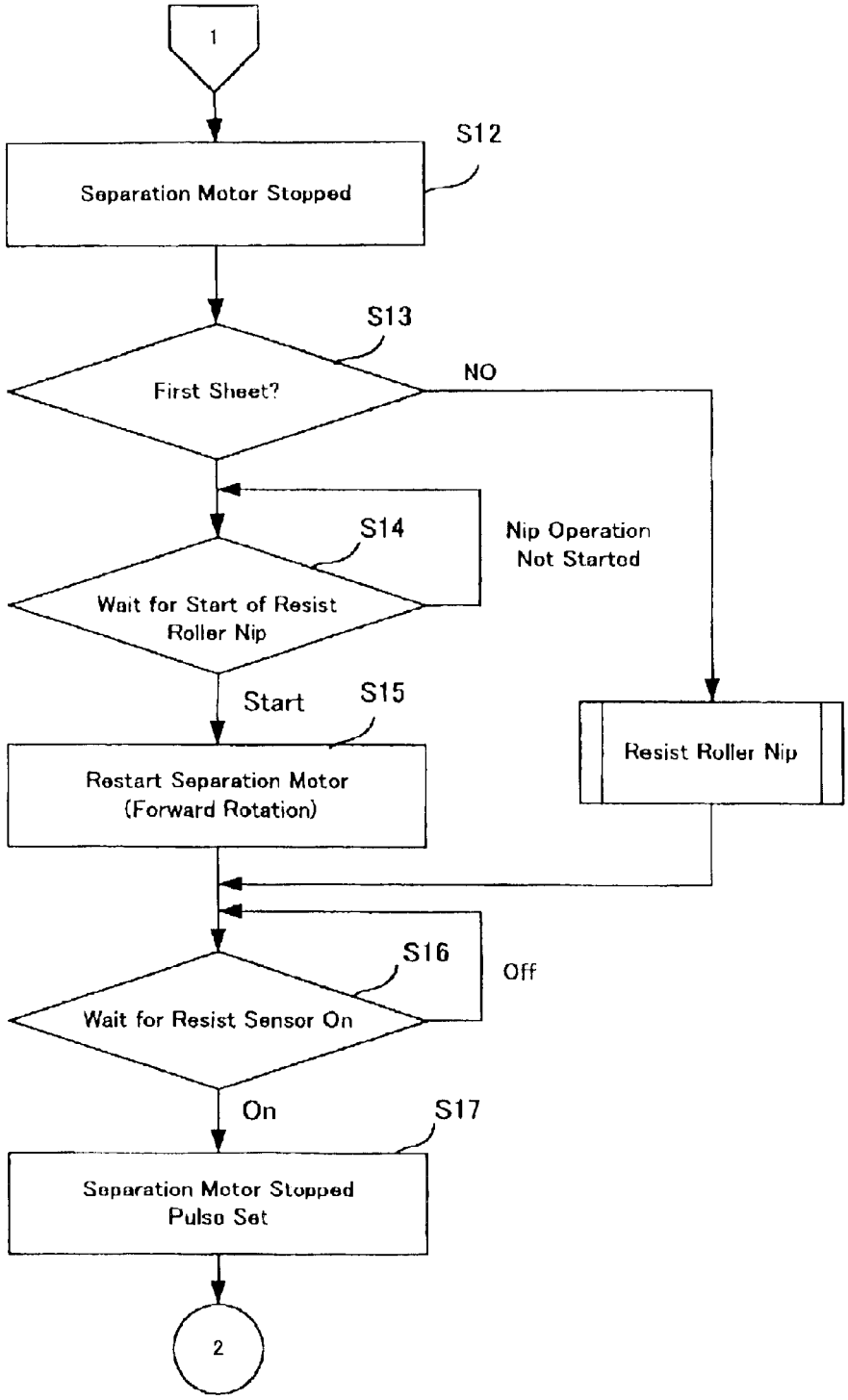
FIG. 18 is a flow chart (No. 3) continued from FIG. 17 to explain the flow of the sheet supply operation.

FIG. 18 is a flow chart continued from FIG. 17 to explain the flow of the sheet separation operation. When the trailing edge of the sheet is detected by the separation sensor 52, the separation motor M1 stops to stop the sheets (S12). (Separation stops the rollers) If it is the first sheet, it waits to start the nipping of the resister rollers 42 (S13, S14). When the nipping of the resister rollers 42 starts, the separation motor M1 restarts (forward rotation) (S15). The sheet is transported and it waits for it to reach the resister sensor 51 (S16). When the resister sensor 51 turns on, the separation motor M1 stops and it sets the timer count pulses (S17).

Note that after the resister sensor 51 detects the leading edge of the sheet at the resister sensor, the separation motor M1 is set to stop when the sheet abuts the resister rollers 42 and forms bend. The bend in the sheet aligns the leading edge of the sheet.

Figure 19:
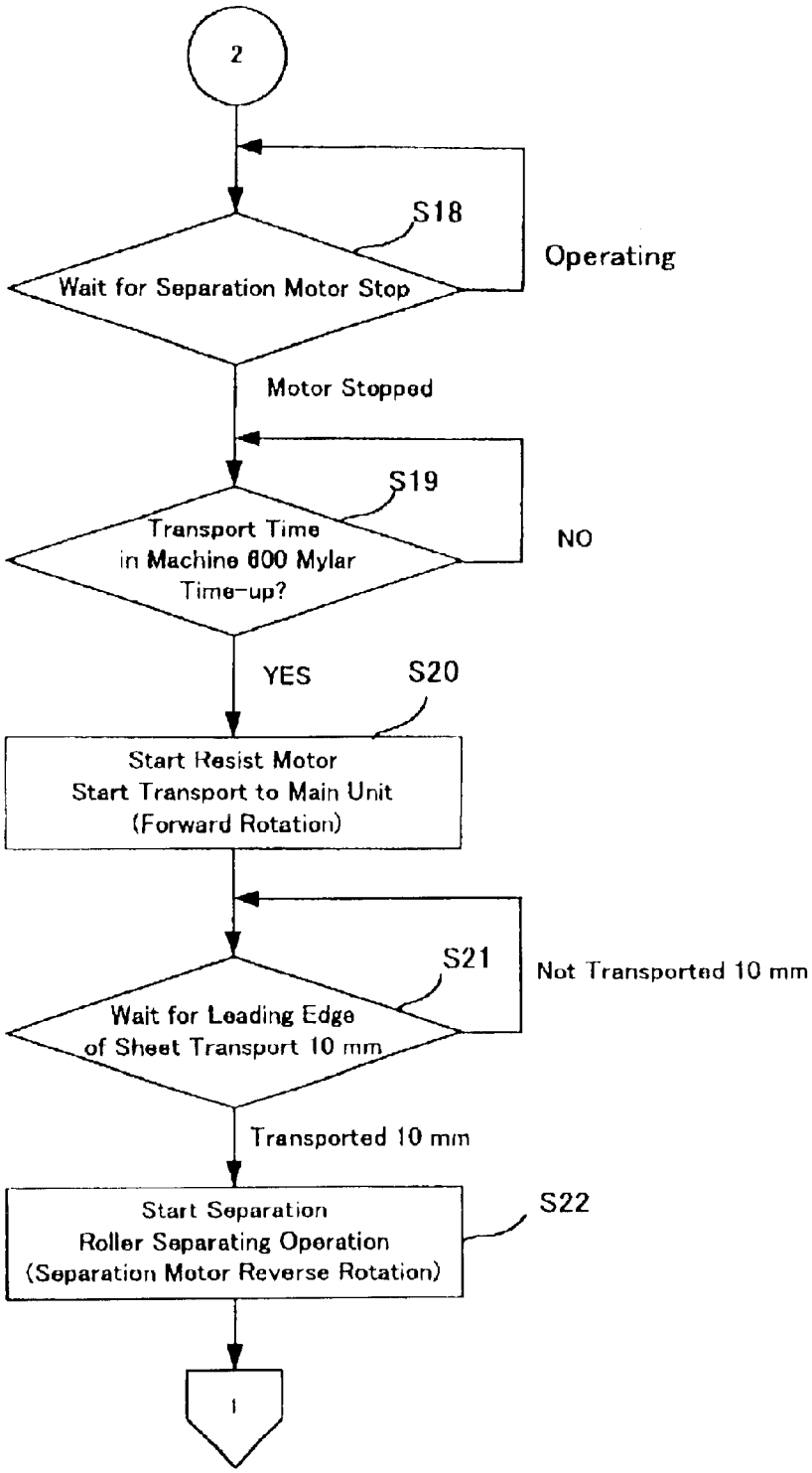
FIG. 19 is a flow chart (No. 4) continued from FIG. 18 to explain the flow of the sheet supply operation.

FIG. 19 is a flow chart continued from FIG. 18 to explain the flow of the sheet separation operation with the resister rollers. It waits for the separation motor to stop and when it does stop (S18), it waits a predetermined amount of time (for example 600 ms) to offset the sheet transport timing (S19). After a predetermined time (600 ms) has passed, the resister motor M2 starts and the transport (forward rotation) of the sheets to the main unit starts (S20). The point where the leading edge of the sheet pass 10 mm from the resister rollers 42, the separation motor M1 starts in reverse to drive the separation rollers 41 to start the separation of the supply rollers (S21, S22).

Figure 20:
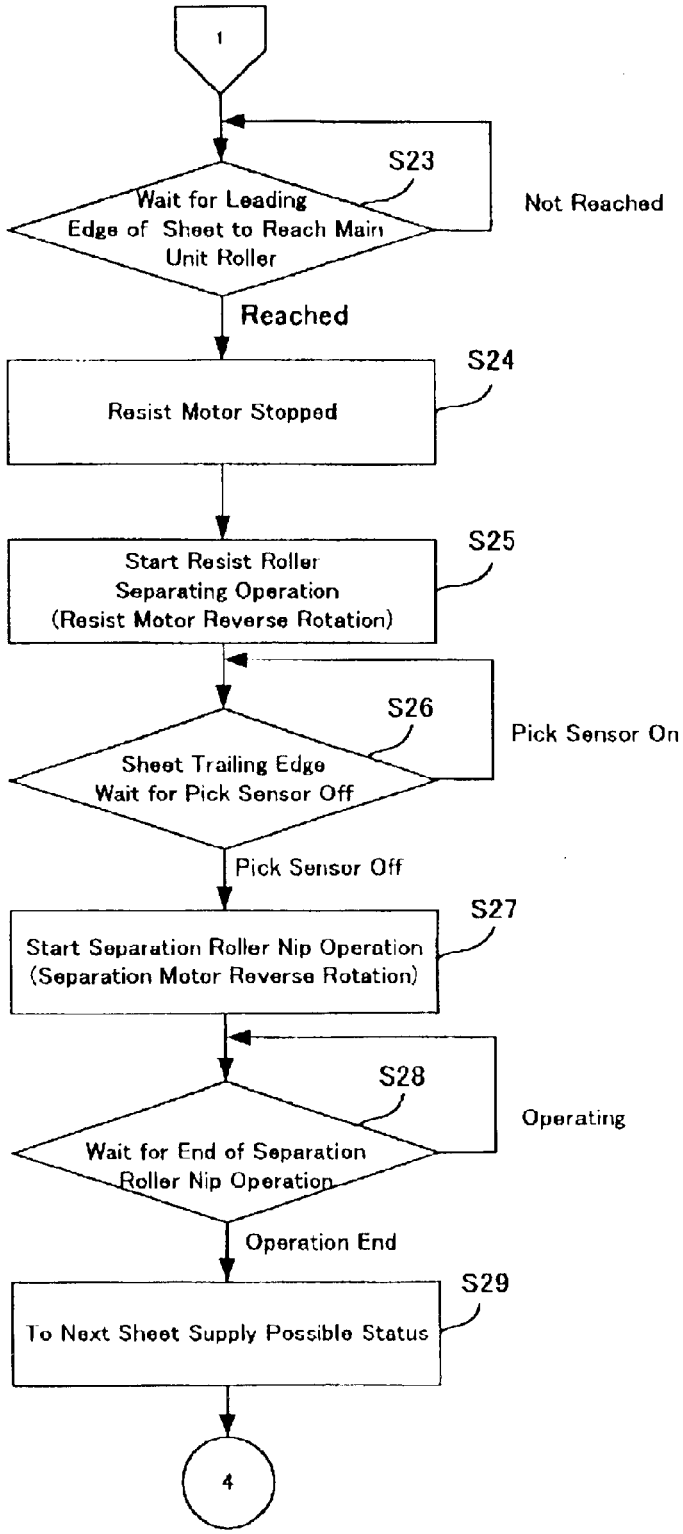
FIG. 20 is a flow chart (No. 5) continued from FIG. 19 to explain the flow of the sheet supply operation.

FIG. 20 is a flow chart continued from FIG. 19 to explain the flow of the sheet S being transported by the resister rollers 42. The aligning roller 9*b* on the main unit side waits for the leading edge of the sheet from the resister rollers 42 (S23). When the leading edge of the sheets arrive, the resister motor M2 stops (S24). Here, the resister motor M2 starts reverse rotation, the resister rollers 42 start separation (S25) When the trailing edge of the sheet passes the pick sensor, the pick sensor turns off (S26) and the separation motor M1 starts reverse rotation. The reverse rotation of the separation motor M1 starts the nipping operation of the separation roller 41 that had been separated (S27). When the separation roller 41 is nipped, it is possible to transport the next sheet (S28, S29).

Figure 21:
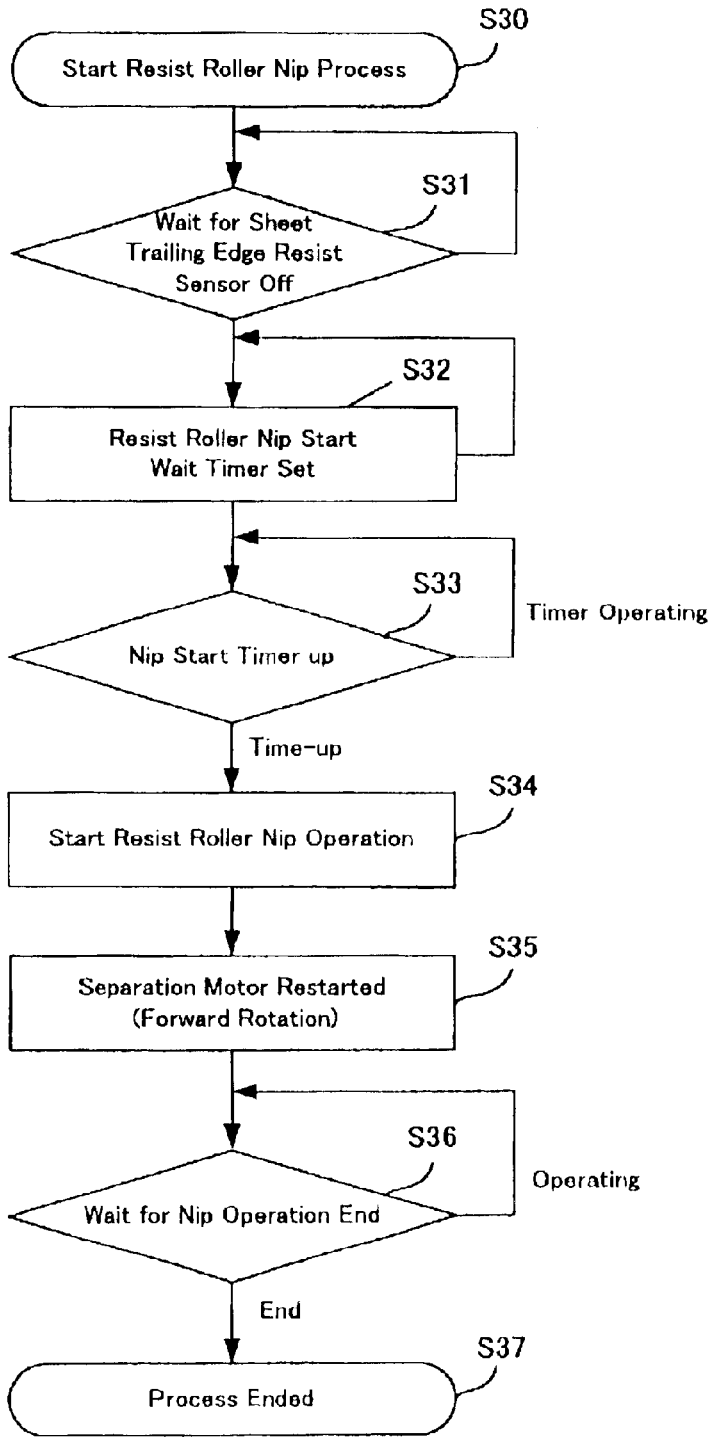
FIG. 21 is a flow chart (No. 6) continued from FIG. 20 to explain the flow of the sheet supply operation.

FIG. 21 is a flow chart continued from FIG. 20 to explain the flow of the nipping of the resister rollers 42. When the sheet trailing edge passes the resister sensor 51 (S31), it sets the timer to wait to start the nipping of the resister rollers 42 that are separated at this point (S32). The time count is started and when the time is up (S33), it starts the nipping operation of the resister rollers 42 (S34). The separation motor M1 is restarted (forward rotation) and it waits for the next sheet. Then, the resister rollers 42 are nipped (S35).

Figure 22:
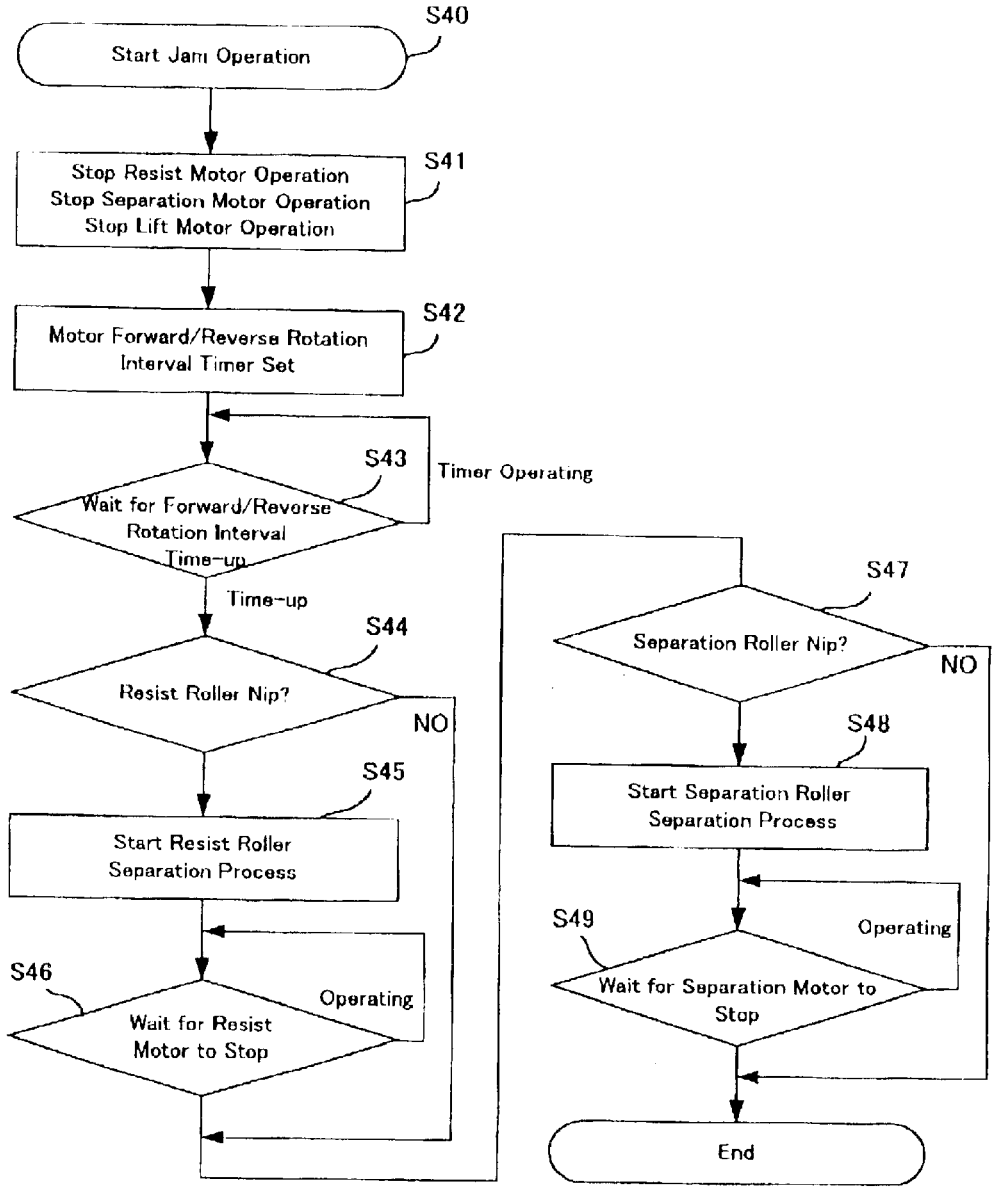
FIG. 22 is a flow chart to explain a flow of operation when the sheets are jammed.

FIG. 22 is a flow chart to explain the flow of operations to separation the rollers when sheets are jammed to make sheet removal easier. Sensors detect jammed sheets and stop the resister motor M2, the separation motor M1 and the lift up motor 11 (S40, S41). The interval timer for motor forward/reverse rotation is set (S42), and when the interval timer time is passed (S43), the resister motor M2 starts to space the resister rollers 42 (S45). After separating and the resister motor M2 stops (S46), the separation of the separation roller 41 is performed in the same way (S47, S48, S49). This makes it easier to remove jammed sheets first reading mode (black and white mode) the separated rollers.

As described in detail above, the sheet supply apparatus 1 according to the present invention is a sheet supply apparatus 1 that supplies sheets to an image forming apparatus H that comprises sheet aligning means for aligning the sheet S to a predetermined sheet transport reference in a sheet transport direction, and comprises sheet storage means for stacking storing the sheet S, sheet pick-up means for feeding sheets from the aforementioned sheet storage means, separating means comprising supply rollers 40 that supply sheets fed from the aforementioned sheet pick-up means and separating members that pressingly contact the aforementioned supply rollers 40, paired resister rollers that feed sheet S to the aforementioned aligning means after resister correction to align the transport direction of sheet S separated by the aforementioned separating means, and a frame for supporting each of the aforementioned means, the first press separating means for setting the aforementioned supply roller 40 and the aforementioned separating member 41 to a sheet nipping state or a sheet released state and the second press separating means for setting the aforementioned resister rollers to a sheet nipping state or to a sheet released state.

Also the aforementioned first press separating means shift supply roller 40 and the separation roller 41 after the leading edge of the sheet S reaches the paired resister rollers 42 and the aforementioned second press separating means shift the aforementioned paired resister rollers 42 from the sheet nipping state to the sheet released state after the leading edge of the sheet S reaches the aforementioned sheet aligning means.

In the sheet supply apparatus 1 according to the present invention, the leading edge of the sheet S is resister corrected for alignment, and after feeding the sheet to the aligning means in the image forming apparatus H, the sheet nipping is released so it is possible to ensure positioning alignment of sheets using the aligning means and to realize high speed transporting of sheets to the image forming apparatus H.

Furthermore, the sheet supply apparatus 1 according to the present invention is equipped with the separating means comprising the supply roller 40 established in the sheet transport path and the separating member that presses against the aforementioned supply roller 40, paired relay rollers that transport sheets separated by the aforementioned separating means in the transport direction downstream the sheet transport path, the first drive means the comprise the first press separating means that rotate the aforementioned supply roller 40 in the sheet transport direction with the forward direction rotation and set the aforementioned supply roller 40 and separating means to a sheet nipping state or a sheet released state with reverse direction rotation, and a second drive means that comprise the second press separating means that rotate the aforementioned paired relay rollers in the sheet transport direction with the forward direction rotation and set the aforementioned paired relay rollers to the sheet nipping state or a sheet released state with reverse direction rotation.

By switching the aforementioned first drive means from a forward direction rotation to a reverse direction rotation after the leading edge of the sheet reaches the aforementioned paired relay rollers, the aforementioned supply roller 40 and the separating means are set to a sheet released state, and by switching the second drive means from a forward direction rotation to a reverse direction rotation after the leading edge of the sheet reaches a predetermined position downstream in the direction of sheet transport, the aforementioned paired relay rollers are set to a sheet released state.

Through this, the present invention can perform the drive to roller to feed sheets and the operation to release the nip of the sheets in the aforementioned roller when sequentially feeding sheets between rollers, with one motor. This enables the smooth feed of sheets to the aligning means to align sheets on the predetermined sheet transport reference in the sheet transport direction from the sheet supply apparatus 1 with a simple mechanism and enables high speed sheet transport.

In addition, the sheet supply apparatus according to the present invention comprises sheet storage means for storing stacked sheets, sheet pick-up means for feeding sheets from the aforementioned sheet storage means, separating means comprising supply rollers to supply sheets fed from the aforementioned sheet pick-up means and separating members that pressingly contact the aforementioned supply rollers, paired resister rollers to align the leading edge of sheets separated by the aforementioned separating means and to feed to sheets to the transport rollers arranged downstream of the sheet supply path, the first drive means that comprise the first press separating means that set the aforementioned separating member to a sheet nipping or sheet released state and for driving the aforementioned separating means and the second drive means that comprise the second press separating means that set the aforementioned paired resister rollers to a sheet nipping state or sheet released state and for driving the aforementioned paired resister rollers, the first press separating means shifts the aforementioned separating means from a sheet nipping state to a sheet released state after a sheet is fed to the aforementioned paired resister rollers, and shifts the aforementioned separating means to the sheet nipping state after the aforementioned sheet trailing edge passes the aforementioned separating means.

Through these the separating means can shift from the sheet released state to the sheet nipping state, the sheet pick-up means can pick-up the next sheet for the sheet separating means so the present invention is able to supply sheets to the image forming apparatus at high speed.

Finally, according to the present invention although the operation to transport sheets using the aforementioned first drive means and the operation to shift the aforementioned paired resister rollers from a sheet released state to a sheet nipping state using the aforementioned second press separating means overlap and are performed together at a predetermined time, the starting of the drive of the aforementioned first drive means and the starting of the drive of the aforementioned second drive means are controlled so that their starting timings do not overlap, and after one of either of the motors of the first motor that composes the aforementioned first drive means or the second motor that comprises the second drive means is at a constant speed, the other motor is started so the maximum current load on the apparatus is reduced thereby realizing efficient sheet transport.

What is claimed is:

1. A sheet automatic supply apparatus for supplying sheets to an image forming apparatus having sheet aligning means for aligning the sheets at a predetermined sheet transport reference in a sheet transport direction, comprising:

sheet storage means for stacking and storing the sheets;

sheet pick-up means for drawing the sheets from the sheet storage means;

separating means having a supply roller for supplying the sheets drawn from the sheet pick-up means and separating members pressing the supply roller;

a pair of resister rollers for supplying the sheets to the sheet aligning means after resister correction to align a sheet supply direction of the sheets separated and supplied by the separating means;

frame means for supporting each of the means;

first press separating means for the supply roller and the separating members to be in one of a sheet nipping state and a sheet released state; and second press separating means for the pair of the resister rollers to be in one of a sheet nipping state and a sheet released state.

2. A sheet supply apparatus according to claim 1, wherein said first press separating means is controlled to switch the supply roller and the separating member from the sheet nipping state to the sheet released state after a leading edge of the sheets reaches the pair of the resister rollers, and said second press separating means is controlled to switch the pair of the resister rollers from the sheet nipping state to the sheet released state after the leading edge of the sheets reaches the sheet aligning means.

3. A sheet supply apparatus according to claim 2, wherein said sheet aligning means comprises transport rollers for transporting the sheets while aligning one side edge of the sheets relative to the sheet transport reference, and said sheet supply apparatus is configured to be detachable to an image forming apparatus having the sheet aligning means.

4. A sheet supply apparatus according to claim 3, wherein said sheet supply apparatus is provided with a sheet supply reference for a side edge of the sheets that are supplied, said sheet supply reference arranged to shift inside relative to the sheet transport reference at a side of the image forming apparatus.

5. A sheet supply apparatus according to claim 1, wherein said sheet pick-up means is provide with a roller touching a top surface of the sheets and support means for supporting the roller to freely swing toward downstream in the sheet supply direction of the roller around an upstream side in the sheet supply direction of the roller.

6. An image forming apparatus, comprising:

a first unit having a sheet aligning roller for aligning sheets while transporting the sheets to a predetermined sheet transport reference in a sheet transport direction, and a second unit detachably mounted to said first unit, said second unit including sheet storage means for stacking and storing the sheets; sheet pick-up means for drawing the sheets in the sheet storage means; separating means comprising supply rollers for supplying the sheets drawn from the sheet pick-up means and separating members pressing the supply rollers; a pair of resister rollers for feeding the sheets to the sheet aligning means in the first unit after resister correction to align a sheet supply direction of the sheets separated and supplied by the separating means; frame means for supporting each of the means; first press separating means for the supply roller and the separating members to be in one of a sheet nipping state and a sheet released state; and second press separating means for the pair of the resister rollers to be in one of a sheet nipping state and a sheet released state.

7. An image forming apparatus according to claim 6, wherein said sheet aligning means in the first unit comprises transport rollers for transporting the sheets while aligning one side edge of the sheets relative to the sheet transport reference, and said second unit comprises a sheet supply reference for a side edge of the sheets that are supplied, said sheet supply reference arranged to shift inside relative to the sheet transport reference at a side of the first unit.

8. A sheet supply apparatus for separating and supplying stacked sheets, comprising:

separating means comprising supply rollers established in a sheet transport path and separation members pressing the supply rollers, a pair of relay rollers for transporting a sheet separated by the separating means in a transport direction downstream in the sheet supply path, first drive means comprising first press separating means for rotating the supply rollers in the sheet supply direction with a forward rotation, and for the supply rollers and the separating members to be in one of a sheet nipping state and a sheet released state with a reverse rotation, second drive means comprising second press separating means for rotating the pair of the relay rollers in the sheet supply direction with a forward rotation, and for the pair of the relay rollers to be in one of a sheet nipping state and a sheet released state with a reverse rotation, and control means for controlling the first drive means to switch from the forward rotation to the reverse rotation for the supply roller and the separating means to be in the sheet released state after a leading edge of the sheets reaches the pair of the relay rollers, and for controlling the second drive means to switch from the forward rotation to the reverse rotation for the pair of the relay rollers to be in the sheet released state after the leading edge of the sheets reaches a predetermined position downstream in the sheet transport direction.

9. A sheet supply apparatus according to claim 8, wherein said first press separating means is arranged so that the supply rollers and the separating members form one of the sheet nipping state and the sheet released state according to an amount of the reverse rotation of the first drive means.

10. A sheet supply apparatus according to claim 8, wherein said second press separating means is arranged so that the pair of the relay rollers forms one of the sheet nipping state and the sheet released state according to an amount of the reverse rotation of the second drive means.

11. A sheet supply apparatus according to claim 8, further comprising sheet detection means for detecting the sheets passing in the sheet transport path between the separating means and the pair of the relay rollers so that the first drive means rotates in reverse to switch the supply rollers and the separating means to the sheet nipping state after the detection means detects a trailing edge of the sheets.

12. A sheet supply apparatus according to claim 8, further comprising sheet aligning means for aligning the sheets to a predetermined sheet transport reference in the sheet transport direction to supply the sheets to an image forming apparatus, and sheet storage means for storing the stacked sheets capable of ascending and descending.

13. A sheet supply apparatus for separating and supplying stacked sheets, comprises:

sheet storage means for stacking and storing the sheets, sheet pick-up means for drawing the sheets in the sheet storage means, separating means comprising supply rollers for supplying the sheets drawn from the sheet pick-up means, and separating members pressing the supply rollers, a pair of resister rollers for aligning a leading edge of the sheets separated and transported by the separating means, and for supplying the sheets to the transport rollers arranged at downstream of a sheet transport path, first press separating means for the separating means to be in one of a sheet nipping state and a sheet released state, said first press separating means switching the separating means from the sheet nipping state to the sheet released state after feeding the sheets to the pair of the resister rollers, said first press separating means switching the separating means to the sheet nipping state after a trailing edge of the sheets passes the separating means, first drive means for driving the separating means, second press separating means for the pair of the resister rollers to be in one of a sheet nipping state and a sheet released state, and second drive means for driving the pair of the resister rollers.

14. A sheet supply apparatus according to claim 13, further comprising sheet detection means for detecting the sheets passing in the sheet transport path between the separating means and the pair of the resister rollers, said first press separating means switching the separating means to the sheet nipping state after the detection means detects the trailing edge of the sheets passing.

15. A sheet supply apparatus according to claim 13, wherein said second press separating means switches the pair of the resister rollers from the sheet nipping state to the sheet released state after the sheets are supplied to the transport rollers, and switches the pair of the resister rollers to the sheet nipping state after the trailing edge of the sheets passes the pair of the resister rollers.

16. A sheet supply apparatus according to claim 15, wherein said first drive means drives to supply the sheets at the same time said second press separating means drives to switch the pair of the resister rollers between the sheet released state and the sheet nipping state for a predetermined period of time.

17. A sheet supply apparatus according to claim 16, further comprising control means for controlling so that the first drive means starts driving to supply the sheets at a time different from when the second press separating means starts driving to switch the states.

18. A sheet supply apparatus according to claim 13, wherein one of said first motor constituting the first drive means and said second motor constituting the second press separating means starts after the other of the motors reaches a constant speed.

19. A sheet supply apparatus according to claim 13, wherein said sheet supply apparatus is arranged to be detachable to an image forming apparatus having sheet aligning means including transport rollers for transporting the sheets while aligning one side edge of the sheets at the sheet transport reference.

20. A sheet supply apparatus according to claim 19, further comprising sheet detection means for detecting the sheets passing in the sheet transport path between the pair of the resister rollers and the sheet aligning means, said press separating means switches the resister rollers to the sheet nipping state immediately after the detection means detects the trailing edge of the sheets passing.

* * * * *